US009372465B2

(12) United States Patent
Ikeda et al.

(10) Patent No.: US 9,372,465 B2
(45) Date of Patent: Jun. 21, 2016

(54) COOLING DEVICE AND IMAGE FORMING APPARATUS INCLUDING SAME

(71) Applicants: Keisuke Ikeda, Kanagawa (JP); Tomoyasu Hirasawa, Kanagawa (JP); Yutaka Shoji, Kanagawa (JP); Kenji Ishii, Ibaraki (JP); Takeshi Watanabe, Ibaraki (JP); Susumu Tateyama, Ibaraki (JP); Hiroaki Miyagawa, Ibaraki (JP); Hiromitsu Fujiya, Kanagawa (JP)

(72) Inventors: Keisuke Ikeda, Kanagawa (JP); Tomoyasu Hirasawa, Kanagawa (JP); Yutaka Shoji, Kanagawa (JP); Kenji Ishii, Ibaraki (JP); Takeshi Watanabe, Ibaraki (JP); Susumu Tateyama, Ibaraki (JP); Hiroaki Miyagawa, Ibaraki (JP); Hiromitsu Fujiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/248,652

(22) Filed: Apr. 9, 2014

(65) Prior Publication Data

US 2014/0308058 A1 Oct. 16, 2014

(30) Foreign Application Priority Data

| | | |
|---|---|---|
| Apr. 10, 2013 | (JP) | 2013-081953 |
| May 22, 2013 | (JP) | 2013-107851 |
| Jan. 29, 2014 | (JP) | 2014-014344 |
| Feb. 26, 2014 | (JP) | 2014-035245 |

(51) Int. Cl.
*G03G 15/20* (2006.01)
*G03G 15/00* (2006.01)

(52) U.S. Cl.
CPC ..... *G03G 15/6573* (2013.01); *G03G 15/2021* (2013.01); *G03G 15/2017* (2013.01); *G03G 2215/0129* (2013.01)

(58) Field of Classification Search
CPC ..... G03G 15/2021
USPC ..... 399/341
See application file for complete search history.

(56) References Cited

U.S. PATENT DOCUMENTS

| | | | | |
|---|---|---|---|---|
| 5,539,511 | A * | 7/1996 | Wenthe et al. | 399/361 |
| 6,618,573 | B2 * | 9/2003 | Ishikawa et al. | 399/328 |

(Continued)

FOREIGN PATENT DOCUMENTS

| | | |
|---|---|---|
| JP | 5-072926 | 3/1993 |
| JP | 2005-84109 A | 3/2005 |

(Continued)

OTHER PUBLICATIONS

English machine translation of JP2012098677A; by Ikeda et al.; "Cooler and Image Forming Device"; published May 24, 2012.*

(Continued)

*Primary Examiner* — David Gray
*Assistant Examiner* — Geoffrey Evans
(74) *Attorney, Agent, or Firm* — Oblon, McClelland, Maier & Neustadt, L.L.P

(57) ABSTRACT

A recording-material cooling device is disposed downstream from a fixing device in a transport direction of a recording material. The fixing device includes a fixing member and a pressing member to fix an unfixed toner image on the recording material. The recording-material cooling device includes a first cooling unit disposed at a same side as the pressing member relative to the recording material, a second cooling unit disposed at a same side as the fixing member relative to the recording material, and a third cooling unit disposed at the same side as the pressing member relative to the recording material. The first cooling unit, the second cooling unit, and the third cooling unit are arranged in an order of the first cooling unit, the second cooling unit, and the third cooling unit from upstream to downstream in the transport direction of the recording material.

21 Claims, 30 Drawing Sheets

(56) References Cited

U.S. PATENT DOCUMENTS

| | | | | |
|---|---|---|---|---|
| 2006/0171749 | A1 | 8/2006 | Tomita et al. | |
| 2010/0008695 | A1 | 1/2010 | Okano et al. | |
| 2010/0261108 | A1* | 10/2010 | Yamanouchi | G03G 9/08711 430/97 |
| 2011/0030927 | A1 | 2/2011 | Okano et al. | |
| 2011/0052247 | A1 | 3/2011 | Saitoh et al. | |
| 2011/0052248 | A1 | 3/2011 | Nishimura et al. | |
| 2011/0052249 | A1* | 3/2011 | Iijima | G03G 15/6573 399/94 |
| 2011/0170895 | A1 | 7/2011 | Fujiya et al. | |
| 2012/0061057 | A1 | 3/2012 | Okano et al. | |
| 2012/0070180 | A1 | 3/2012 | Iijima et al. | |
| 2012/0227927 | A1 | 9/2012 | Fujiya et al. | |
| 2012/0263491 | A1 | 10/2012 | Fujiya et al. | |
| 2012/0315069 | A1 | 12/2012 | Ikeda et al. | |
| 2012/0328343 | A1* | 12/2012 | Kunii et al. | 399/341 |
| 2013/0259512 | A1 | 10/2013 | Ikeda et al. | |
| 2013/0302076 | A1* | 11/2013 | Sakamoto | G03G 8/00 399/341 |
| 2014/0044462 | A1 | 2/2014 | Ikeda et al. | |
| 2014/0060782 | A1* | 3/2014 | Ikeda | B41J 11/007 165/104.26 |
| 2014/0064809 | A1* | 3/2014 | Yamaguchi | G03G 15/2057 399/341 |
| 2015/0075207 | A1* | 3/2015 | Karikusa | B65H 29/12 62/380 |
| 2015/0160610 | A1* | 6/2015 | Watanabe | G03G 21/206 271/272 |
| 2015/0253699 | A1* | 9/2015 | Shimojima | G03G 21/206 399/94 |
| 2016/0018171 | A1* | 1/2016 | Van Den Kerkhof | B41J 29/377 347/223 |
| 2016/0026125 | A1* | 1/2016 | Ishii | G03G 21/20 399/341 |

FOREIGN PATENT DOCUMENTS

| | | |
|---|---|---|
| JP | 2007-121653 | 5/2007 |
| JP | 2009-175260 | 8/2009 |
| JP | 2011-057389 | 3/2011 |
| JP | 2011-191502 | 9/2011 |
| JP | 2012-098677 | 5/2012 |
| JP | 2012-255964 | 12/2012 |
| JP | 2013-003517 | 1/2013 |
| JP | 2013-011636 | 1/2013 |
| JP | 2013-97222 A | 5/2013 |

OTHER PUBLICATIONS

Extended European Search Report issued Aug. 7, 2014 in Patent Application No. 14163886.6.

U.S. Appl. No. 14/140,854, filed Dec. 26, 2013.

U.S. Appl. No. 14/140,888, filed Dec. 26, 2013.

* cited by examiner

COOLING DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application Nos. 2013-081953, filed on Apr. 10, 2013, 2013-107851, filed on May 22, 2013, 2014-014344, filed on Jan. 29, 2014, and 2014-035245, filed on Feb. 26, 2014, in the Japan Patent Office, the entire disclosure of each of which is hereby incorporated by reference herein.

BACKGROUND

1. Technical Field

Exemplary embodiments of this disclosure relate to a cooling device to cool a sheet-type recording material and an image forming apparatus including the cooling device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such an electrophotographic image forming apparatus may have a fixing device to heat and press a toner image transferred onto a recording material (e.g., a sheet of paper) to fix the toner image on the recording material. After fixing, when recording materials are stacked in such heated state, toner is softened by heat retained in the stacked recording materials, and the stacked recording materials are pressed by their own weights. As a result, the stacked recording materials may adhere to each other with softened toner. Such an adhering state of the stacked recording materials is referred to as blocking phenomenon. If such recording materials adhering to each other are forcefully separated, the toner images fixed on the recording materials may be damaged. To suppress blocking, a recording-material cooling device may be used to cool a recording material after a toner image is fixed on the recording material under heat.

For example, JP-2012-098677-A proposes a configuration of cooling a recording material from both faces of the recording material to enhance cooling efficiency.

Alternatively, for example, JP-2011-057389-A proposes a configuration in which, to reduce resistance between a belt and a contact member, a clearance for introducing air is formed between the belt and the contact member.

BRIEF SUMMARY

In at least one exemplary embodiment of this disclosure, there is provided a recording-material cooling device disposed downstream from a fixing device in a transport direction of a recording material. The fixing device includes a fixing member and a pressing member to fix an unfixed toner image on the recording material. The fixing member includes a heater. The pressing member contacts the fixing member to form a fixing nip. The recording-material cooling device includes a first cooling unit disposed at a same side as the pressing member relative to the recording material, a second cooling unit disposed at a same side as the fixing member relative to the recording material, and a third cooling unit disposed at the same side as the pressing member relative to the recording material. The first cooling unit, the second cooling unit, and the third cooling unit are arranged in an order of the first cooling unit, the second cooling unit, and the third cooling unit from upstream to downstream in the transport direction of the recording material.

In at least one exemplary embodiment of this disclosure, there is provided an image forming apparatus including the recording-material cooling device and the fixing device.

In at least one exemplary embodiment of this disclosure, there is provided a recording-material cooling device including a first conveyance assembly, a second conveyance assembly, and a cooling unit. The first conveyance assembly includes a plurality of first stretching members and a first belt rotatably stretched by the plurality of first stretching members. The second conveyance assembly includes a plurality of second stretching members and a second belt rotatably stretched by the plurality of second stretching members. The first conveyance assembly and the second conveyance assembly are arranged to sandwich and convey a recording material with the first belt and the second belt while cooling the recording material. The cooling unit contacts an inner circumferential surface of at least one of the first belt and the second belt. The cooling unit has a main heat absorbing surface and an auxiliary heat absorbing surface. The auxiliary heat absorbing surface has a curved surface of a smaller curvature radius than a curvature radius of a curved surface of the main heat absorbing surface. At least one of a rotation trajectory of the first belt and a rotation trajectory of the second belt passes a route deviated toward the cooling unit from a tangent line at a border point between the main heat absorbing surface and the auxiliary heat absorbing surface.

In at least one exemplary embodiment of this disclosure, there is provided an image forming apparatus including the recording-material cooling device.

In at least one exemplary embodiment of this disclosure, there is provided a recording-material cooling device disposed downstream from a fixing device in a transport direction of a recording material. The fixing device includes a fixing member and a pressing member to fix an unfixed toner image on the recording material. The fixing member includes a heater. The pressing member contacts the fixing member to form a fixing nip. The recording-material cooling device includes a pressing-member-side cooling unit disposed at a same side as the pressing member relative to the recording material and a fixing-member-side cooling unit disposed at a same side as the fixing member relative to the recording material. The pressing-member-side cooling unit and the fixing-member-side cooling unit are arranged in an order of the pressing-member-side cooling unit and the fixing-member-side cooling unit from upstream to downstream in the transport direction of the recording material. An amount of heat which the pressing-member-side cooling unit absorbs from the recording material is greater than an amount of heat which the fixing-member-side cooling unit absorbs from the recording material.

In at least one exemplary embodiment of this disclosure, there is provided an image forming apparatus including the recording-material cooling device and the fixing device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
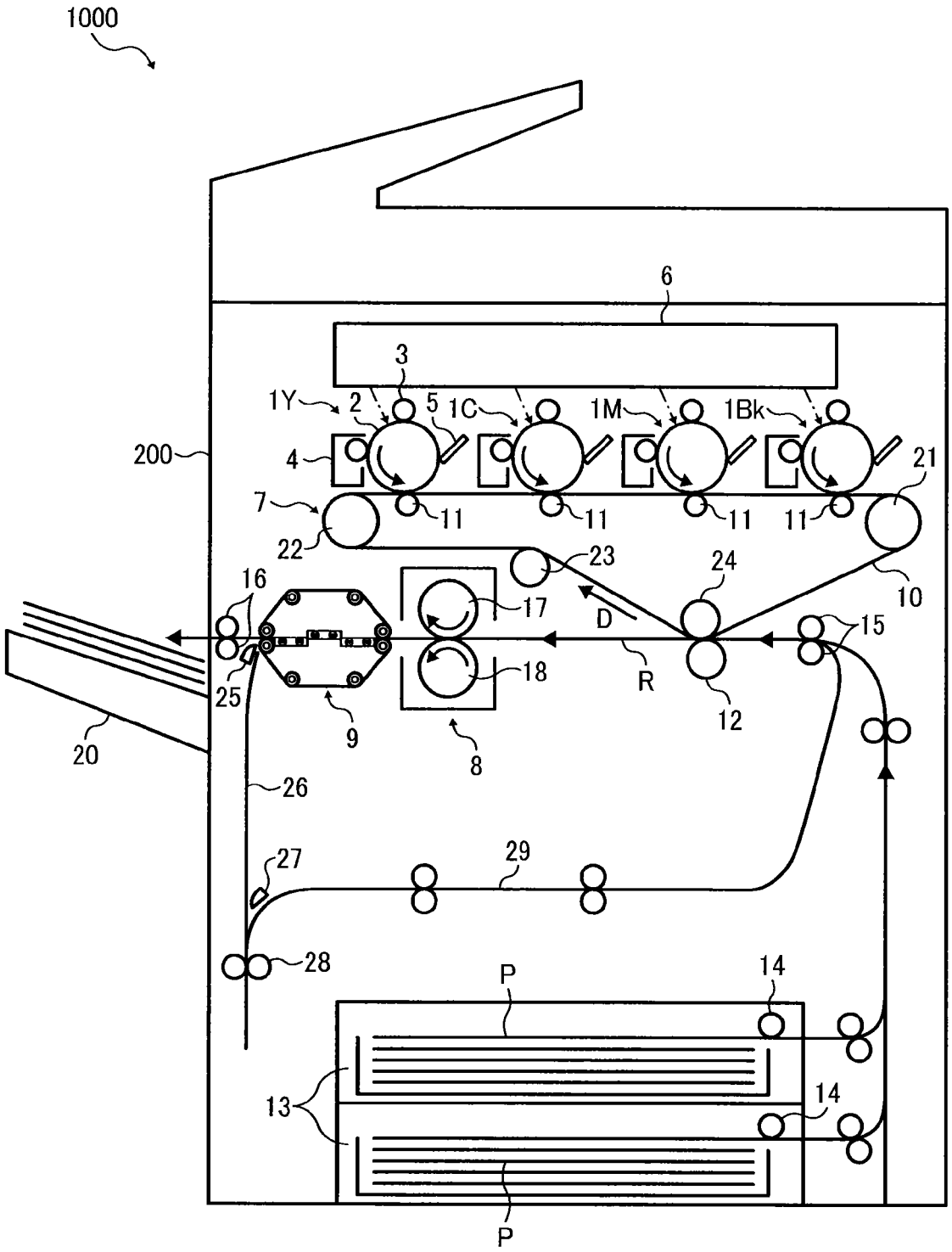
FIG. 1 is a schematic view of a color image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

FIG. 1 is a schematic view of a color image forming apparatus 1000 according to an embodiment of this disclosure.

The image forming apparatus 1000 illustrated in FIG. 1 includes a tandem-type image forming section in which four process units 1Y, 1C, 1M, and 1Bk serving as image forming units are arranged in tandem. The process units 1Y, 1C, 1M, and 1Bk are removably mountable relative to an apparatus body 200 of the image forming apparatus 1000 and have substantially the same configuration except for containing different color toners of yellow (Y), cyan (C), magenta (M), and black (Bk) corresponding to color separation components of a color image.

Specifically, each of the process units 1Y, 1C, 1M, and 1Bk includes, e.g., a photoreceptor 2, a charging roller 3, a developing device 4, and a cleaning blade 5. The photoreceptor 2 has, e.g., a drum shape and serves as a latent image carrier. The charging roller 3 serves as a charging device to charge a surface of the photoreceptor 2. The developing device 4 forms a toner image on the surface of the photoreceptor 2. The cleaning blade 5 serves as a cleaner to clean the surface of the photoreceptor 2. In FIG. 1, the photoreceptor 2, the charging roller 3, the developing device 4, and the cleaning blade 5 of the process unit 1Y for yellow are represented by the photoreceptor 2Y, the charging roller 3Y, the developing device 4Y, and the cleaning blade 5Y, respectively. Regarding the other process units 1C, 1M, and 1Bk, color index are omitted for simplicity.

In FIG. 1, above the process units 1Y, 1C, 1M, and 1Bk, an exposing device 6 is disposed to expose the surface of the photoreceptor 2. The exposing device 6 includes, e.g., a light source, polygon mirrors, f-θ lenses, and reflection lenses to irradiate a laser beam onto the surface of the photoreceptor 2.

A transfer device 7 is disposed below the process units 1Y, 1C, 1M, and 1Bk. The transfer device 7 includes an intermediate transfer belt 10 constituted of an endless belt serving as a transfer body. The intermediate transfer belt 10 is stretched over a plurality of rollers 21 to 24 serving as support members. One of the rollers 21 to 24 is rotated as a driving roller to circulate (rotate) the intermediate transfer belt 10 in a direction indicated by arrow D in FIG. 1.

Four primary transfer rollers 11 serving as primary transfer devices are disposed at positions at which the primary transfer rollers 11 oppose the respective photoreceptors 2. At the respective positions, the primary transfer rollers 11 are pressed against an inner circumferential surface of the intermediate transfer belt 10. Thus, primary transfer nips are formed at positions at which the photoreceptors 2 contact pressed portions of the intermediate transfer belt 10. Each of the primary transfer rollers 11 is connected to a power source, and a predetermined direct current (DC) voltage and/or an alternating current (AC) voltage are supplied to the primary transfer rollers 11.

A secondary transfer roller 12 serving as a second transfer device is disposed at a position at which the secondary transfer roller 12 opposes the roller 24, which is one of the rollers over which the intermediate transfer belt 10 is stretched. The secondary transfer roller 12 is pressed against an outer circumferential surface of the intermediate transfer belt 10. Thus, a secondary transfer nip is formed at a position at which the secondary transfer roller 12 and the intermediate transfer belt 10 contact each other. Like the primary transfer rollers 11, the secondary transfer roller 12 is connected to a power source, and a predetermined direct current (DC) voltage and/or an alternating current (AC) voltage are supplied to the secondary transfer roller 12.

Below the apparatus body 200 is disposed a plurality of feed trays 13 to store sheet-type recording materials P, such as sheets of paper or overhead projector (OHP) sheets. Each feed tray 13 is provided with a feed roller 14 to feed the recording materials P stored. An output tray 20 serving as a sheet output unit is mounted on an outer surface of the apparatus body 200 at the left side in FIG. 1 to stack recording materials P discharged to an outside of the apparatus body 200.

The apparatus body 200 includes a transport path R to transport a recording material P from the feed trays 13 to the output tray 20 through the secondary transfer nip. On the transport path R, registration rollers 15 are disposed upstream from the secondary transfer roller 12 in a transport direction of a recording material (hereinafter, recording-material transport direction). A fixing device 8, a recording-material cooling device 9, and paired output rollers 16 are disposed in turn at positions downstream from the secondary transfer roller 12 in the recording-material transport direction. The fixing device 8 includes a fixing roller 17 and a pressing roller 18. The fixing roller 17 serves as a fixing member including an internal heater. The pressing roller 18 serves as a pressing member to press the fixing roller 17. A fixing nip is formed at a position at which the fixing roller 17 and the pressing roller 18 contact each other.

Next, a typical operation of the image forming apparatus 1000 is described with reference to FIG. 1.

When imaging operation is started, the photoreceptor 2 of each of the process units 1Y, 1C, 1M, and 1Bk is rotated counterclockwise in FIG. 1, and the charging roller 3 uniformly charges the surface of the photoreceptor 2 with a predetermined polarity. Based on image information of a document read by a reading device, the exposing device 6 irradiates laser light onto the charged surface of the photoreceptor 2 to form an electrostatic latent image on the surface of the photoreceptor 2. At this time, image information exposed to each photoreceptor 2 is single-color image information obtained by separating a desired full-color image into single-color information on yellow, cyan, magenta, and black. Each developing device 4 supplies toner onto the electrostatic latent image formed on the photoreceptor 2, thus making the electrostatic latent images a visible image as a toner image.

One of the rollers 21 to 24 over which the intermediate transfer belt 10 is stretched is driven for rotation to circulate the intermediate transfer belt 10 in the direction indicated by arrow D in FIG. 1. A voltage having a polarity opposite a charged polarity of toner and subjected to constant voltage or current control is supplied to each of the primary transfer rollers 11. As a result, a transfer electric field is formed at the primary transfer nip between each primary transfer roller 11 and the opposing photoreceptor 2. Toner images of respective colors on the photoreceptors 2 are transferred one on another onto the intermediate transfer belt 10 by the transfer electric fields formed at the primary transfer nips. Thus, the intermediate transfer belt 10 bears a full-color toner image on the surface of the intermediate transfer belt 10. Residual toner remaining on each photoreceptor 2 without being transferred onto the intermediate transfer belt 10 is removed with the cleaning blade 5.

With rotation of the feed roller 14, a recording material P is fed from the corresponding feed tray 13. The recording material P is further sent to the secondary transfer nip between the secondary transfer roller 12 and the intermediate transfer belt 10 by the registration rollers 15 so as to synchronize with the full-color toner image on the intermediate transfer belt 10. At this time, a transfer voltage of the polarity opposite the charged polarity of toner of the toner image on the intermediate transfer belt 10 is supplied to the secondary transfer roller 12. As a result, a transfer electric field is formed at the secondary transfer nip. By the transfer electric field formed at the secondary transfer nip, the toner image on the intermediate transfer belt 10 is collectively transferred onto the recording material P. Then, the recording material P is sent into the fixing device 8, and the fixing roller 17 and the pressing roller 18 apply heat and pressure to fix the toner image on the recording material P. After the recording material P is cooled with the recording-material cooling device 9, the paired output rollers 16 output the recording material P onto the output tray 20.

For duplex (double-side) printing, a switching tab 25 is switched to guide the recording material P to a reverse path 26 after cooling. Further, a switching tab 27 is switched to rotate, e.g., a roller 28 in reverse. As a result, the reversed recording material P is fed from a reverse path 29 to the registration rollers 15 again, and thus the recording material is turned upside down. In such a process, a toner image serving as a back-face image is formed and born on the intermediate transfer belt 10, and the toner image is transferred onto a back face of the recording material P. Through the fixing process of the fixing device 8 and the cooling process of the recording-material cooling device 9, the recording material P is discharged onto the output tray 20 by the paired output rollers 16.

The above description relates to image forming operation for forming a full color image on a recording material. In other image forming operation, a single color image can be formed by any one of the process units 1Y, 1C, 1M, and 1Bk, or a composite color image of two or three colors can be formed by two or three of the process units 1Y, 1C, 1M, and 1Bk.

Figure 2A:
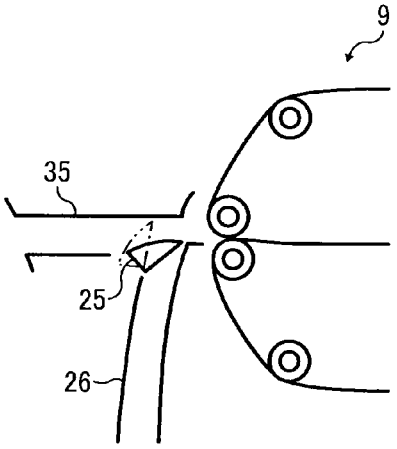
FIGS. 2A and 2B are schematic views of a guide unit to guide a recording material having passed the recording-material cooling device to a reverse path or a sheet output unit.
Figure 2B:
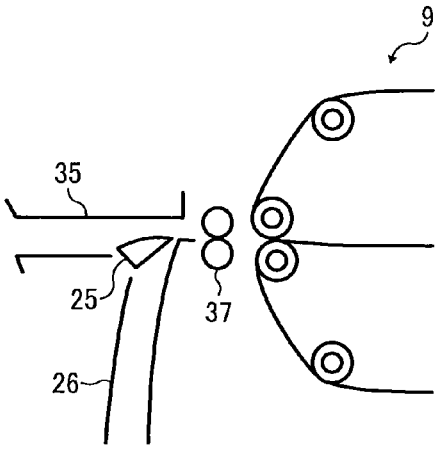

FIGS. 2A and 2B are schematic views of a guide unit to guide a recording material P having passed the recording-material cooling device 9 to the reverse path or the sheet output unit.

The guide unit to guide the recording material P having passed the recording-material cooling device 9 is disposed downstream from the recording-material cooling device 9 in the transport direction of the recording material P. In an example illustrated in FIG. 2A, a conveyance guide plate 35 serving as the guide unit and a switching tab 25 are provided downstream from the recording-material cooling device 9. When the switching tab 25 is placed at a first position indicated by a solid line in FIG. 2A during simplex (single-face) printing, the recording material P is guided to the conveyance guide plate 35 and discharged to the output tray 20 by the paired output rollers 16. In duplex printing, the switching tab 25 is switched from the first position to a second position indicated by a broken line, and the recording material P is guided to the reverse path 26. In an example illustrated in FIG. 2B, a conveyance guide plate 35 and rollers 37 serving as the guide unit and a switching tab 25 are provided downstream from the recording-material cooling device 9 in the transport direction of the recording material P. The rollers 37 guide the recording material P toward the conveyance guide plate 35 and the switching tab 25 while preventing bending of the recording material P, and the recording material P is discharged or reversed in accordance with a position of the switching tab 25.

Figure 3:
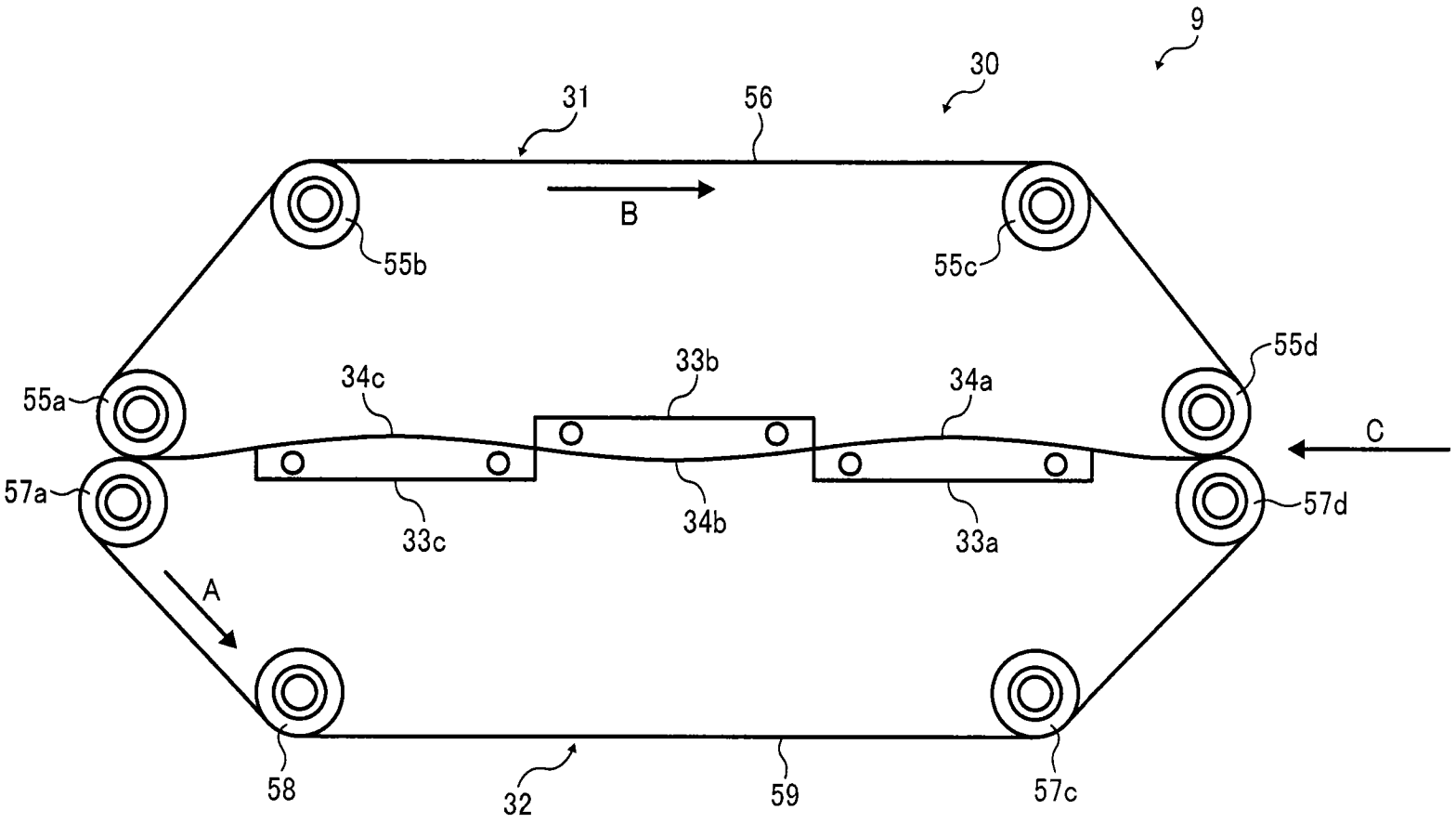
FIG. 3 is an enlarged view of the recording-material cooling device illustrated in FIG. 1.

As illustrated in FIG. 3, the recording-material cooling device 9 has cooling members 33 to cool a sheet-type recording material P conveyed by traveling of belts of a belt conveyance unit 30. The belt conveyance unit 30 includes a first conveyance assembly 31 and a second conveyance assembly 32. The first conveyance assembly 31 is disposed at one face side (front face side or upper face side) of the sheet-type recording material P. The second conveyance assembly 32 is disposed at the other face side (back face side or lower face side) of the sheet-type recording material P. Each of the first conveyance assembly 31 and the second conveyance assembly 32 has at least one of the cooling members 33. A cooling member (liquid cooling plate) 33*a* of the cooling members 33 serving as a first cooling unit and a pressing-member-side cooling unit is disposed at the other face side (back face side or lower face side) of the sheet-type recording material P. A cooling member 33*b* of the cooling members 33 serving as a second cooling unit and a fixing-member-side cooling unit is disposed at the one face side (front face side or upper face side) of the sheet-type recording material P. A cooling member 33*c* of the cooling members 33 serving as a third cooling unit and a pressing-member-side cooling unit is disposed at the other face side (back face side or lower face side) of the sheet-type recording material P.

The cooling members 33*a*, 33*b*, and 33*c* are disposed offset in a traveling direction of the sheet-type recording material P. The cooling member 33*b* at the one face side has, as a lower surface, a heat absorbing surface 34*b* of an arc surface shape slightly protruding downward. The cooling members 33*a* and 33*c* at the other face side have, as upper surfaces, heat absorbing surfaces 34*a* and 34*c* of an arc surface shape slightly protruding upward. Each of the cooling members 33*a*, 33*b*, and 33*c* includes a cooling-liquid channel through which cooling liquid flows.

Figure 4:
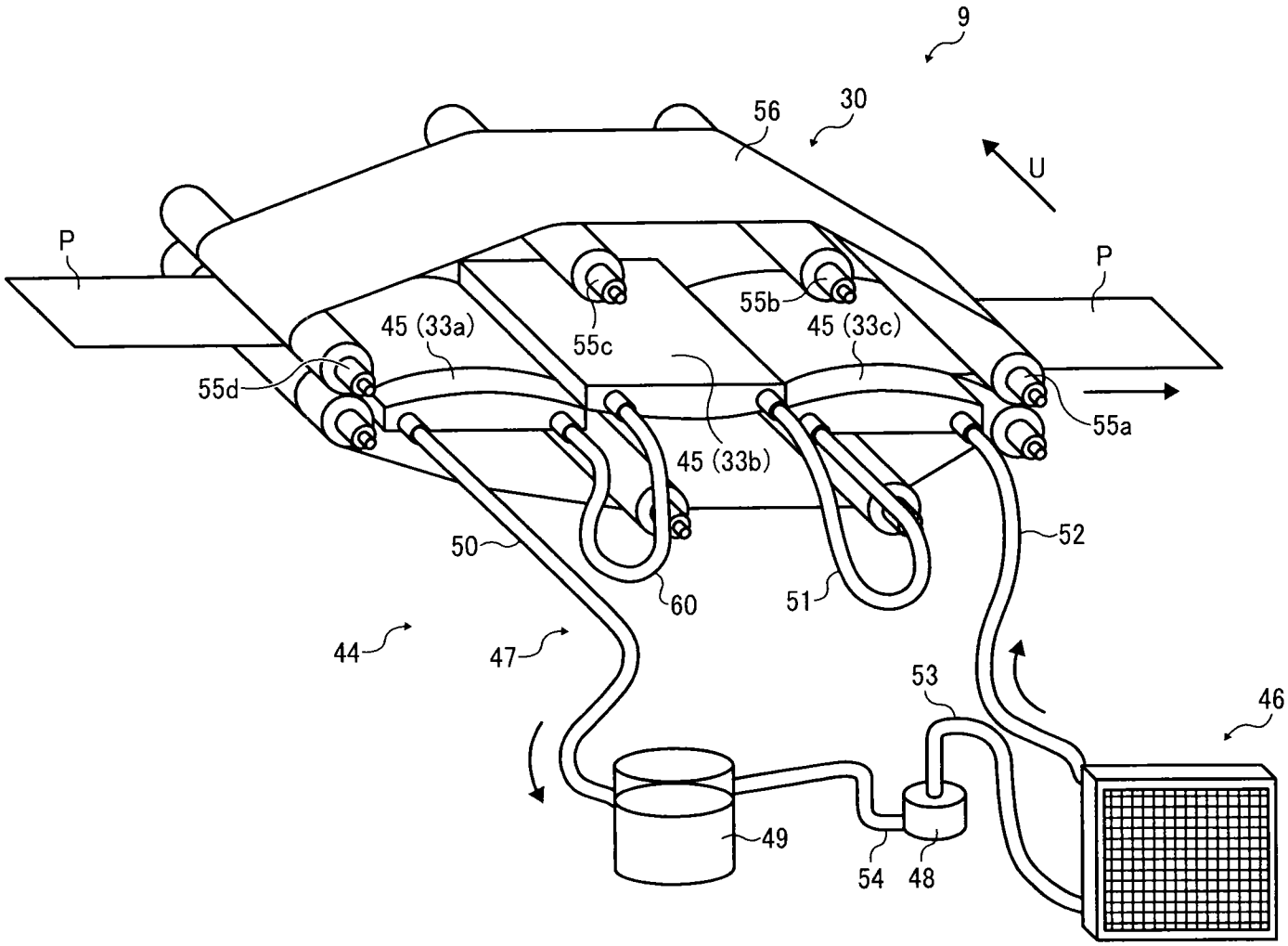
FIG. 4 is a schematic view of a configuration of the recording-material cooling device seen from a rear side thereof.

In other words, as illustrated in FIG. 4, the recording-material cooling device 9 has a cooling-liquid circuit 44. The cooling-liquid circuit 44 includes a heat receiving part 45 to receive heat from a recording material P serving as a heat generating part, a heat dissipating part 46 to radiate heat of the heat receiving part 45, and a circulation channel 47 to circulate cooling liquid through the heat receiving part 45 and the heat dissipating part 46. The circulation channel 47 includes a pump 48 to circulate cooling liquid and a liquid tank 49 to store cooling liquid. Each of the cooling members 33*a*, 33*b*, and 33*c*, which are, e.g., liquid cooling plates, functions as the heat receiving part 45. The heat dissipating part 46 includes, e.g., a radiator. The cooling liquid is, for example, a liquid that contains water as main component and an antifreeze (e.g., propylene glycol or ethylene glycol) to reduce the freezing point, and an antirust (e.g., phosphate material: phosphoric acid potassium salt, or inorganic potassium salt) as additives.

The circulation channel 47 includes pipes 50, 60, 51, 52, 53, and 54. The pipe 50 connects a first opening of the cooling member 33*a* to the liquid tank 49. The pipe 60 connects a second opening of the cooling member 33*a* to a first opening of the cooling member 33*b*. The pipe 51 connects a second opening of the cooling member 33*b* to a first opening of the cooling member 33*c*. The pipe 52 connects a second opening of the cooling member 33*c* to the heat dissipating part 46 (e.g., radiator). The pipe 53 connects the heat dissipating part 46 to the pump 48. The pipe 54 connects the pump 48 to the liquid tank 49. The circulation channel 47 including the pipes 50, 60, 51, 52, 53, and 54 forms a single channel. However, the circulation channel 47 meanders in the cooling members 33*a*, 33*b*, and 33*c*, thus allowing cooling liquid to effectively cool the cooling members 33*a*, 33*b*, and 33*c*.

The first conveyance assembly 31 includes a plurality of rollers (driven rollers) 55 (e.g., four rollers 55*a*, 55*b*, 55*c*, and 55*d* in FIG. 3) and a belt (conveyance belt) 56 wound around the plurality of rollers 55. The second conveyance assembly 32 includes a plurality of rollers (driven rollers) 57*c*, 57*d*, and 58 and a driving roller 57*a* (four rollers in FIG. 3), and a belt (conveyance belt) 59 wound around the plurality of rollers 57*c*, 57*d*, and 58 and the driving roller 57*a*.

Accordingly, a recording material P is sandwiched and conveyed by the belt 56 of the first conveyance assembly 31 and the belt 59 of the second conveyance assembly 32. In other words, as illustrated in FIG. 3, the belt 59 is traveled in a direction indicated by arrow A by driving of the driving roller 57*a*. With travel of the belt 59, the belt 56 of the first conveyance assembly 31 is traveled in a direction indicated by arrow B via the recording material P sandwiched between the belts 56 and 59. Thus, the recording material P is conveyed from an upstream side to a downstream side in a direction indicated by arrow C in FIG. 3.

Next, operation of the recording-material cooling device having the above-described configuration is described below.

When the recording material P is sandwiched and conveyed by the belts 56 and 59, as illustrated in, e.g., FIG. 3, the first conveyance assembly 31 and the second conveyance assembly 32 are placed adjacent to each other. In a state illustrated in FIG. 3, if the driving roller 57*a* of the second conveyance assembly 32 is rotated, as described above, the belts 56 and 59 travel in the directions indicated by arrows A and B, respectively, to convey the recording material P in the direction indicated by arrow C. In such a state, cooling liquid is circulated in the cooling-liquid circuit 44. In other words, the pump 48 is activated to flow the cooling liquid through the cooling liquid channels of the cooling members 33*a*, 33*b*, and 33*c*.

At this time, an inner surface of the belt 56 of the first conveyance assembly 31 slides over the heat absorbing surface 34*b* of the cooling member 33*b*, and an inner surface of the belt 59 of the second conveyance assembly 32 slides over the heat absorbing surface 34*a* of the cooling member 33*a* and the heat absorbing surface 34*c* of the cooling member 33*c*. From a front face (upper face) side of the recording material P, the cooling member 33*b* absorbs heat of the recording material P via the belt 56. From a back face (lower face) side of the recording material P, the cooling members 33*c* and 33*a* absorb heat of the recording material P via the belt 59. In such a case, an amount of heat absorbed by the cooling members 33*a*, 33*b*, and 33*c* is transported to the outside by the cooling liquid, thus maintaining the cooling members 33*a*, 33*b*, and 33*c* at relatively low temperatures.

In other words, by driving the pump 48, the cooling liquid is circulated through the cooling-liquid circuit 44. The cooling liquid flows through the cooling-liquid channels of the cooling members 33*a*, 33*b*, and 33*c*, absorbs heat of the cooling members 33*a*, 33*b*, and 33*c* and turns into a relatively high temperature. The cooling liquid at high temperature passes through the heat dissipating part 46 (e.g., radiator), and heat of the cooling liquid is radiated to outside air, thus reducing the temperature of the cooling liquid. The cooling liquid at relatively low temperature flows through the cooling-liquid channels again. By repeating the above-described cycle, the recording material P is cooled from both sides thereof.

Figure 5:
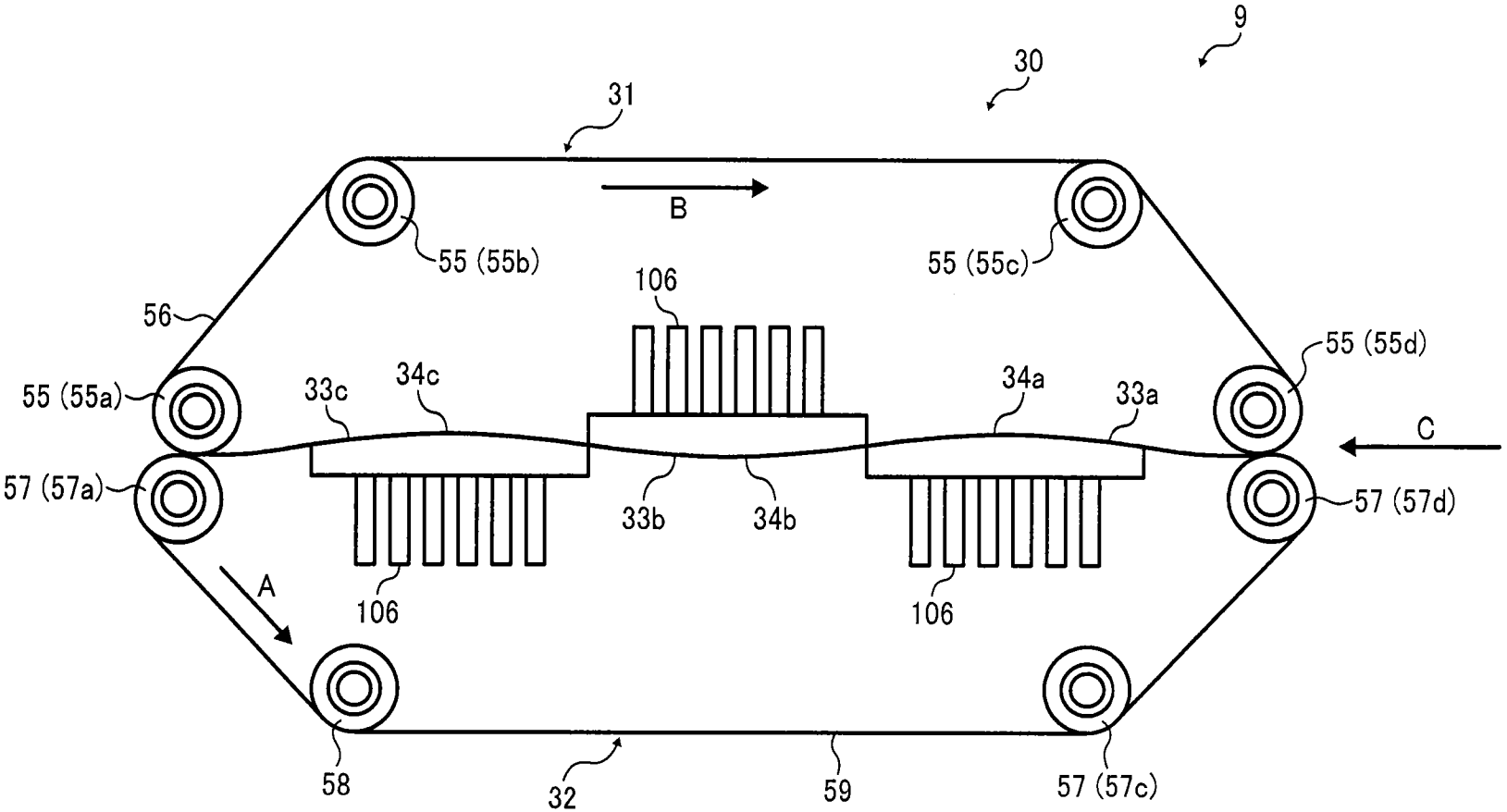
FIG. 5 is a schematic view of a variation of the recording-material cooling device.

In this disclosure, the recording-material cooling device is not limited to the recording-material cooling device 9 employing the cooling-liquid circuit 44. For example, as illustrated in FIG. 5, the recording-material cooling device 9 may include a radiation facilitating part 106 having a shape of facilitating heat radiation. As the radiation facilitating part 106, for example, an air-cooling heat sink having multiple fins is employed. In such a configuration, the relative positions between the heat receiving surfaces 34*a*, 34*b*, and 34*c* and the belts 56 and 59 described in any of the above-described exemplary embodiments are also applicable.

As described above, use of the air-cooling heat sink obviates use of the cooling-liquid circuit 44, thus allowing downsizing and cost reduction of the recording-material cooling device.

Figure 6:
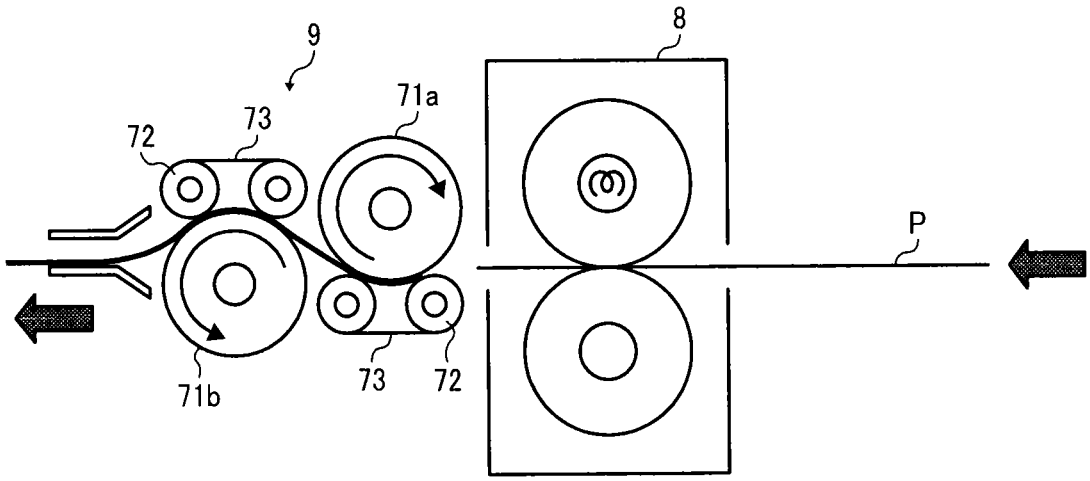
FIG. 6 is a side view of a fixing device and a recording-material cooling device according to a comparative example of this disclosure.

FIG. 6 is a side view of a fixing device and a recording-material cooling device according to a comparative example of this disclosure.

In FIG. 6, a recording-material cooling device 9 according to this comparative example includes rotary cooling rollers 71*a* and 71*b* (hereinafter, collectively referred to as cooling rollers 71 unless distinguished), two pairs of small-diameter rollers 72, and two belts 73. Each roller of the two pairs of small-diameter rollers 72 has a smaller diameter than each of the cooling rollers 71*a* and 71*b*. Each pair of small-diameter rollers 72 is disposed opposing the cooling rollers 71*a* or 71*b*. Each of the belts 73 is looped around the corresponding one pair of small-diameter rollers 72. In fixing operation, the fixing roller 17 of the fixing device 8 applies heat to a recording material P to fix a toner image on a surface of the recording material P. At this time, the recording material P is heated to high temperature.

While the recording material P is sandwiched and conveyed with the cooling rollers 71 and the belts 73, first, a front face, which is an image formed face, of the recording material P is cooled and then a back face of the recording material P is cooled. As described above, by cooling the recording material P from not only the front face, which is an image formed face, but also the back face, the total amount of heat absorbed from the recording material is greater than a configuration in which the two cooling rollers 71 are disposed at the front side of the recording material P.

Figure 7:
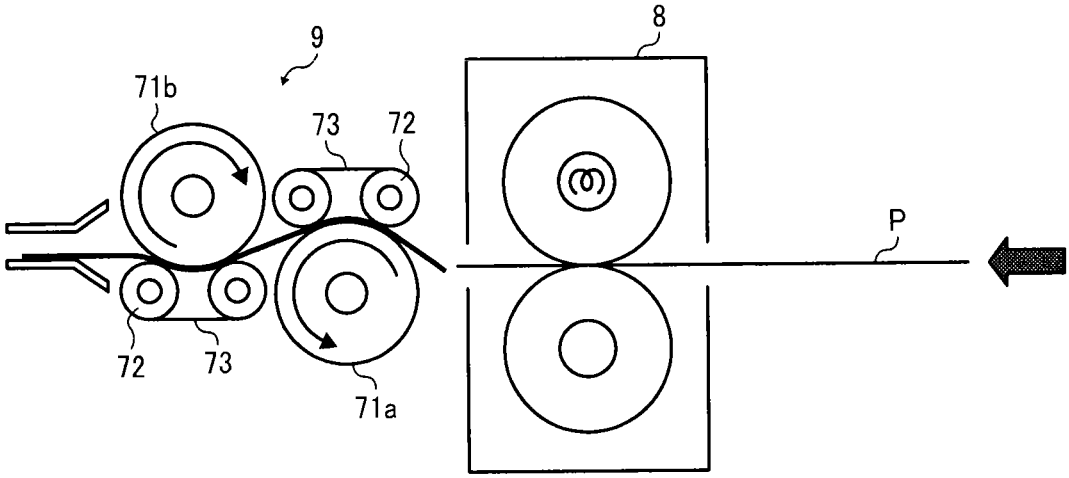
FIG. 7 is a side view of a fixing device and a recording-material cooling device having a basic configuration according to an embodiment of this disclosure.

FIG. 7 is a side view of a fixing device and a recording-material cooling device having a basic configuration according to an embodiment of this disclosure.

In FIG. 7, a recording-material cooling device 9 according to this embodiment includes rotary cooling rollers 71*a* and 71*b*, two pairs of small-diameter rollers 72, and two belts 73. Each roller of the two pairs of small-diameter rollers 72 has a smaller diameter than each of the cooling rollers 71*a* and 71*b*. Each pair of small-diameter rollers 72 is disposed opposing the cooling rollers 71*a* or 71*b*. Each of the belts 73 is looped around the corresponding one pair of small-diameter rollers 72. However, the relative positions of each cooling roller 71 and the corresponding set of the small-diameter rollers 72 and the belt 73 are upside down. Accordingly, first, a back face of a recording material P is cooled and then a front face, which is an image formed face of the recording material P, is cooled.

Next, a difference in effect between a comparative example of FIG. 6 and a basic configuration of this embodiment is described with reference to FIGS. 8 through 11.

Figure 8:
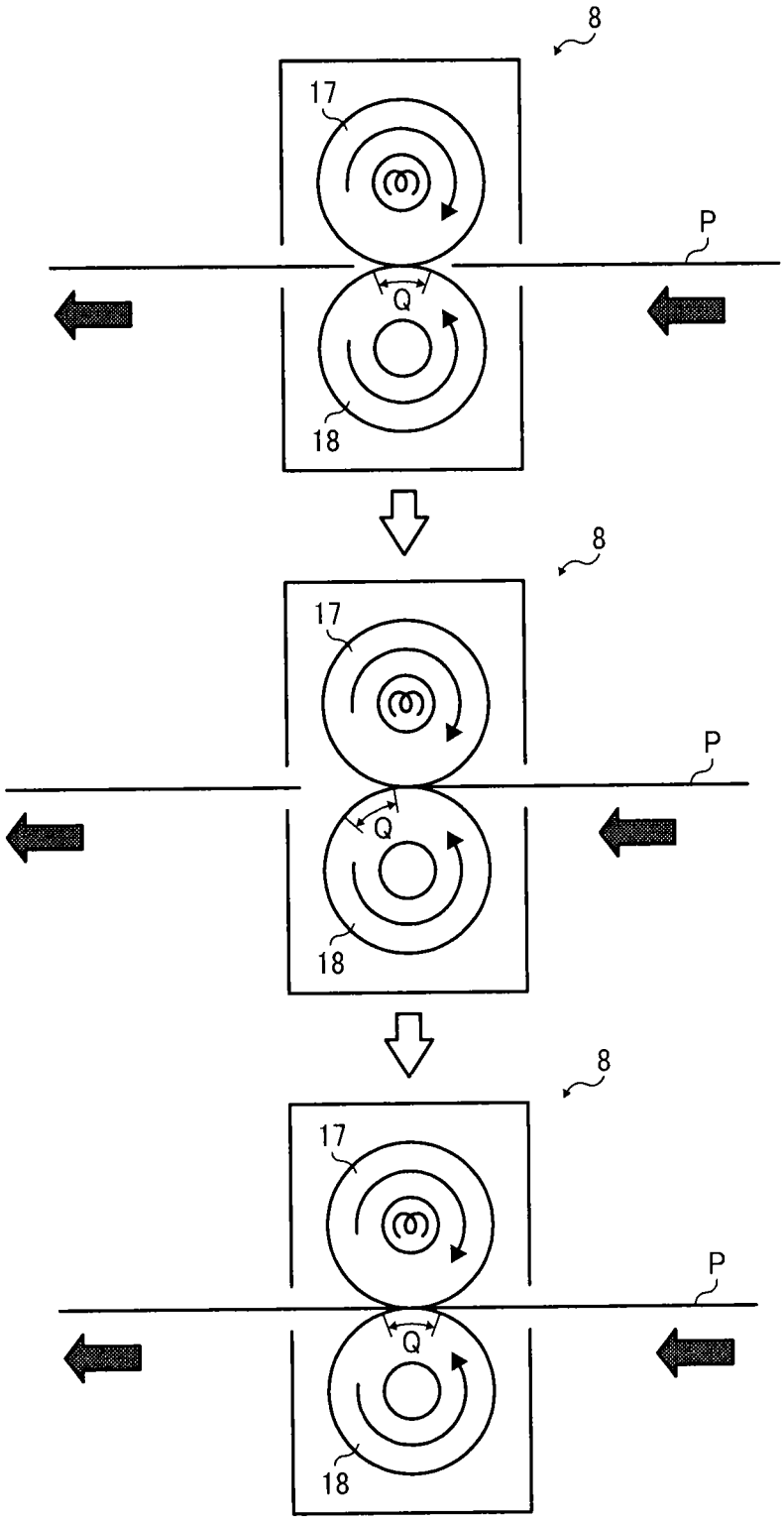
FIG. 8 is a cross-sectional view of an internal structure of a fixing device and an interval between recording materials according to an embodiment of this disclosure.

As illustrated in FIG. 8, the fixing device 8 includes the fixing roller 17 and the pressing roller 18 to fix a toner image on a surface of a recording material P. The fixing roller 17 is adjusted to a constant temperature by an internal heater. When printing is continuously performed on a plurality of recording materials P, there occurs an interval between a recording material P and a subsequent recording material P. As described in FIG. 8, the pressing roller 18 directly contacts the fixing roller 17 at a portion Q of the pressing roller 18 corresponding to the interval between the recording materials P. As a result, the portion Q of the pressing roller 18 is heated to a higher temperature than any other portion of the pressing roller 18. When the portion Q is rotated by 360 degrees and contacts the subsequent recording material P, the back face of the recording material P is heated to a higher temperature by the portion Q.

Figure 9:
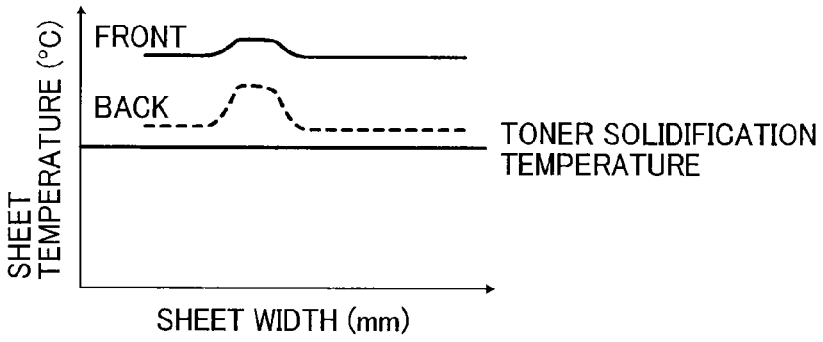
FIG. 9 is a graph of an example of temperature distribution of a recording material after the recording material passes the fixing device.

FIG. 9 is a graph of an example of temperature distribution of a recording material P after the recording material P passes the fixing device 8.

In FIG. 9, the temperature of the recording material P is measured with a sensor disposed immediately downstream from the fixing device 8 in a transport direction of the recording material P. The horizontal axis of the graph represents the width (sheet width) from a leading edge to a trailing edge of the recording material P sensed with the sensor. The vertical axis of the graph represents the temperature (sheet temperature) of the recording material P. As illustrated in FIG. 9, a portion of the back face of the recording material P contacting the portion Q of the pressing roller 18 is heated to a higher temperature than any other portion of the back face. Further, a portion of the front face corresponding to the contacting portion of the back face is also heated to a slightly higher temperature than any other portion of the front face.

Figure 10A:
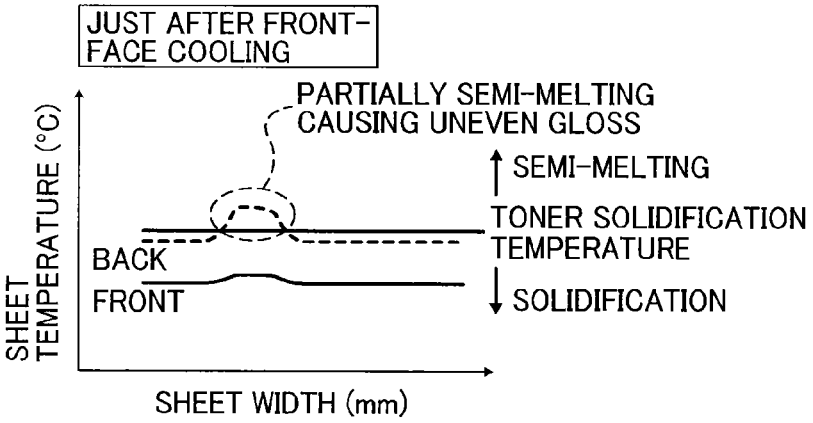
FIGS. 10A and 10B are graphs of temperature changes of the recording material observed when the recording material passes the recording-material cooling device according to the comparative example of FIG. 6.
Figure 10B:
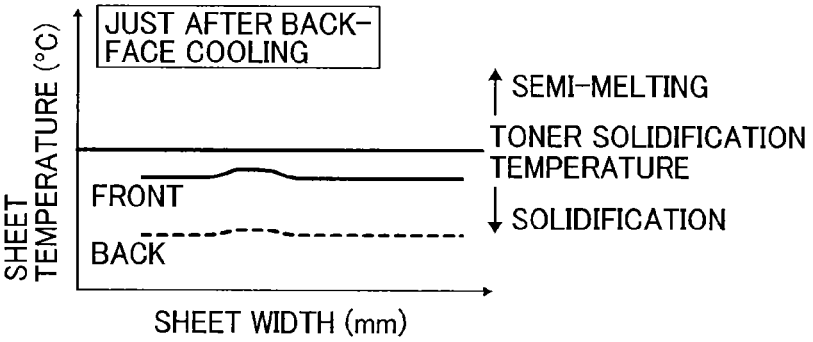

FIGS. 10A and 10B are graphs of temperature changes of the recording material P having such a temperature distribution observed when the recording material P passes the recording-material cooling device according to the comparative example of FIG. 6. In FIGS. 10A and 10B, the temperature of the recording material P is measured with a sensor disposed immediately downstream from the cooling rollers 71*a* and 71*b* in the transport direction of the recording material P.

First, in simplex printing, immediately after the cooling roller 71*a*, i.e., the first one of the cooling rollers 71, cools the front face of the recording material P, the temperature of the recording material P changes as illustrated in FIG. 10A. When the front face of the recording material P is cooled, the temperature of the front face falls below a solidification temperature of toner and the back face of the recording material P also falls. At this time, the toner image formed on the front face (first face) is solidified, and a portion of the back face has a temperature equal to or higher than the toner solidification temperature. Next, as illustrated in FIG. 10B, when the cooling roller 71*b*, i.e., the second one of the cooling rollers 71, is cooled, the back face of the recording material P is entirely cooled to or below the toner solidification temperature. The front face is entirely heated to a temperature still higher than the previous temperature by rebound of heat due to thermal diffusion within the recording material P. As a result, the temperature of the entire front face becomes higher than the back face and lower than the toner solidification temperature.

However, in duplex printing, after the recording material P passes the recording-material cooling device 9, the recording material P is transported along the reverse path 29 and refed to the registration rollers 15, thus causing the recording material P to be reversed (turned upside down). Image formation is formed on the front face (the second face) of the recording material P with the secondary transfer roller 12. After the recording material P passes the fixing device 8, the recording material P has a temperature distribution of FIG. 9 again. As a result, since the temperature of the back face (the first face) becomes a temperature equal to or higher than the toner solidification temperature, the previously solidified toner image on the back face turns into a semi-melted state. Then, the recording material P passes the cooling roller 71*a*, i.e., the first one of the cooling rollers 71 and shows the temperature distribution illustrated in FIG. 10A. Only a high-temperature portion of the back face illustrated in an area encircled by a broken line in FIG. 10A has a higher temperature than the toner solidification temperature. The high-temperature portion of the toner image is softened, and the other low-temperature portion is solidified. Then, the recording material P passes the cooling roller 71*b*, which is the second one of the cooling rollers 71, to cool the back face. As illustrated in FIG. 10B, the recording material P is entirely cooled to a temperature equal to or lower than the toner solidification temperature. However, the occurrence of a time lag in solidifying toner causes uneven brightness.

Figure 11A:
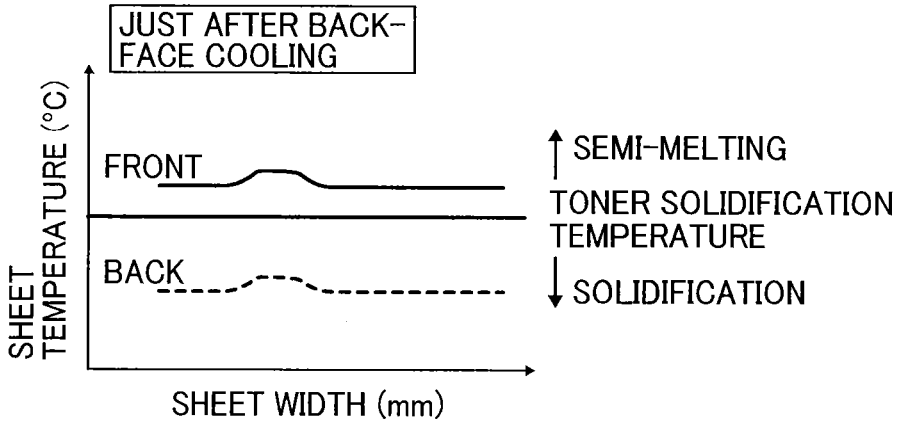
FIGS. 11A and 11B are graphs of temperature changes of the recording material observed when the recording material passes the recording-material cooling device illustrated in FIG. 7.
Figure 11B:
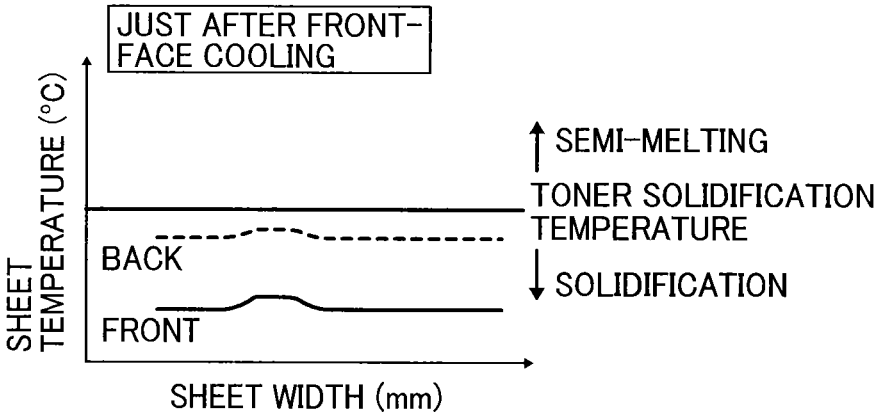

By contrast, for the configuration according to this embodiment illustrated in FIG. 7, the cooling roller 71*a*, which is the first one of the cooling rollers 71, first cools the back face of the recording material P having the temperature distribution illustrated in FIG. 9. For duplex printing, the recording material P has a temperature distribution illustrated in FIG. 11A immediately after the back face (first face) is cooled. Since the entire back face is directly cooled with the cooling roller 71*a* disposed at the most upstream side of the cooling rollers 71, as illustrated in FIG. 11A, the high-temperature portion of the back face, which is caused by the portion Q of the pressing roller corresponding to an interval between recording materials, and the other low-temperature portion are cooled substantially at the same time to a range of temperatures equal to or lower than the toner solidification temperature, i.e., a border at which toner is softened, thus reducing a temperature difference between the high-temperature portion and the low temperature portion. In addition, the cooling of the back face also slightly reduces the temperature of the front face. Next, when the recording material P passes the second cooling roller 71*b* and the front face is cooled with the cooling roller 71*b*, the recording material P has a temperature distribution illustrated in FIG. 11B. In other words, the temperature of the front face falls, and an amount of heat remaining in the recording material P spreads over the back face to slightly increase the temperature of the back face. However, the entire recording material P falls to temperatures equal to or lower than the toner solidification temperature. As a result, during duplex printing, no time lag occurs in toner solidification of the back face (first face). On the other hand, in FIG. 11A, the temperature of the front face (second face) is equal to or higher than the toner solidification temperature and toner is in semi-melted state. By contrast, in FIG. 11B, the temperature of the front face (second face) is entirely equal to or lower than the toner solidification temperature. As a result, no time lag occurs in toner solidification of the front face (second face).

Accordingly, as illustrated in FIG. 7, the cooling rollers 71*a* and 71*b* are disposed in an order of a pressing roller side and a fixing roller side in the transport direction of the recording material to cool the recording material in an order of the back face and the front face. Such a configuration can prevent occurrence of uneven brightness in a toner image formed on the back face in duplex printing.

As described above, cooling a toner image on a recording material P to a toner solidification temperature or lower can prevent influence to brightness of the toner image. However, unless the toner image is cooled to a still lower temperature at which toner adherence can be avoided (hereinafter, referred to as toner-adherence avoidance temperature), the back face of the recording material P may slide against the lower conveyance guide plate by its weight. As a result, the toner image might be peeled off from the back face, thus causing flaws in the toner image. In addition, peeled-off toner might adhere to the lower conveyance guide plate, thus causing contamination of toner to a subsequent recording material P or conveyance failure.

Figure 12:
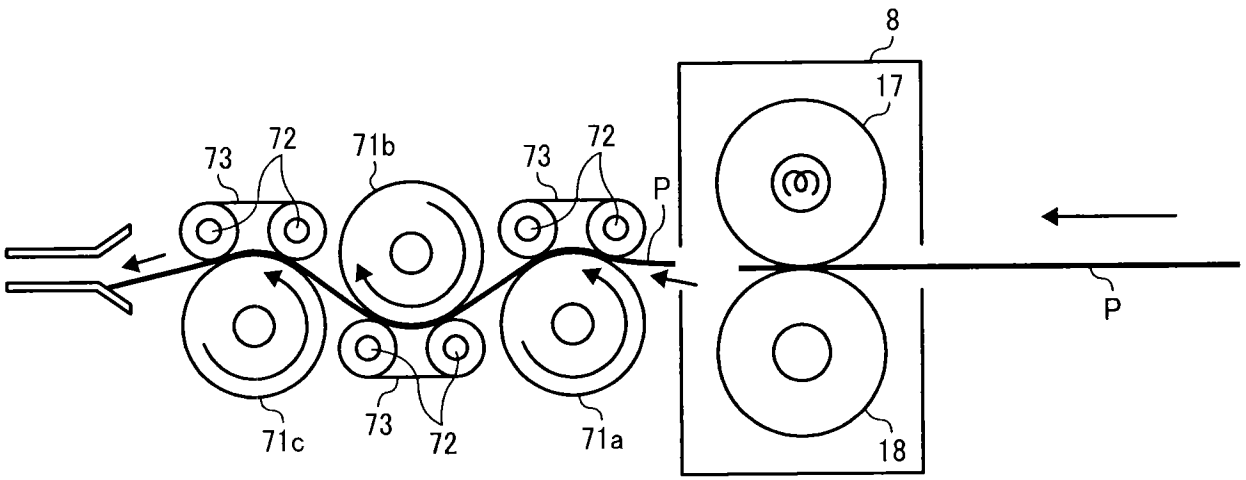
FIG. 12 is a side view of a configuration of a recording-material cooling device according to an embodiment of this disclosure.
Figure 13:
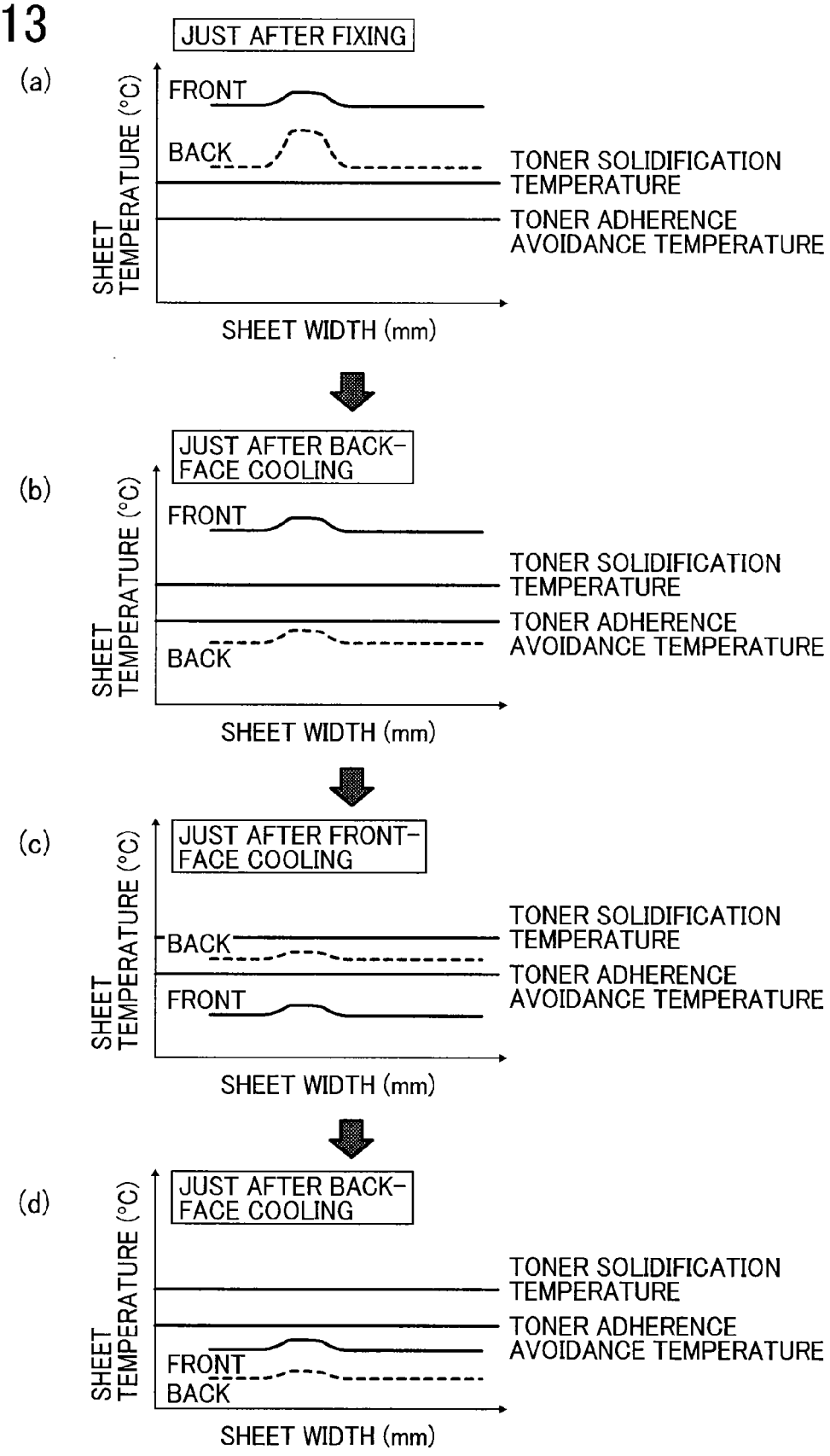
FIG. 13 is a graph of a temperature change of a recording material cooled by the recording-material cooling device illustrated in FIG. 12.
Figure 14:
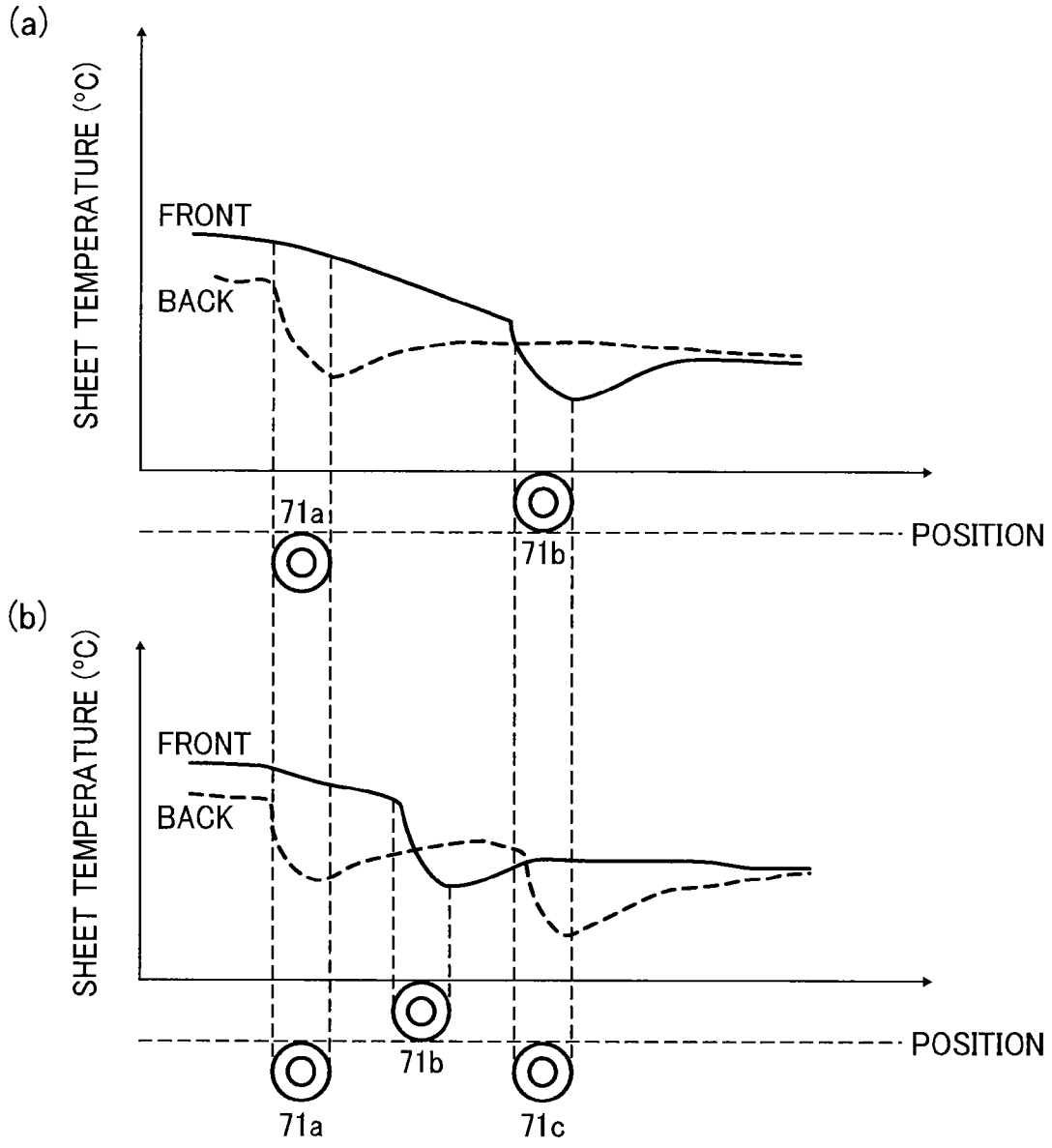
FIG. 14 is a graph of relationships among the positions of cooling rollers, the temperature of a front face of a recording material P (indicated by solid lines), and the temperature of a back face of the recording material P (indicated by broken lines) after the recording material P passes the fixing device.

Hence, according to an embodiment of this disclosure, as illustrated in FIGS. 12 to 14, a third cooling unit is disposed at a most downward position in the recording-material transport direction in the recording-material cooling device illustrated in FIG. 7. Such a configuration can prevent occurrence of uneven brightness in the front face of the recording material P and also prevent adherence of toner to the lower conveyance guide plate and occurrence of image flaws.

FIG. 12 is a side view of a configuration of a recording-material cooling device according to this embodiment of this disclosure.

In FIG. 12, a recording-material cooling device 9 according to this embodiment includes a cooling roller 71*a*, a cooling roller 71*b*, and a cooling roller 71*c* (hereinafter, collectively referred to as cooling rollers 71 unless distinguished). The cooling roller 71*a* serving as a first cooling unit is disposed at a side (pressing roller side) at which a pressing roller 18 is disposed relative to the recording material P conveyed. The cooling roller 71*b* serving as a second cooling unit is disposed at a side (fixing roller side) at which a fixing roller 17 is disposed relative to the recording material P conveyed. The cooling roller 71*c* serving as the third cooling unit is disposed at the pressing roller side. The recording-material cooling device 9 further includes three pairs of small-diameter rollers 72 and three belts 73, each of which is stretched over the corresponding one of the three pairs of small-diameter rollers 72. Each set of the pair of small-diameter rollers 72 and the belts 73 is disposed opposing the corresponding cooling roller 71. In other words, for this configuration, in the recording-material cooling device illustrated in FIG. 7, a set of the cooling roller 71*c* serving as the third cooling unit and the belt 73 stretched over the pair of small-diameter rollers 72 is added at a position downstream from the second cooling roller 71*b* in the recording-material transport direction. The cooling roller 71*c* cools the back face of the recording material P.

Next, operation and advantages of the recording-material cooling device according to this embodiment are described below.

FIG. 13 is a graph of a temperature change of a recording material P cooled by the recording-material cooling device according to this embodiment. In FIGS. 13, (a), (b), and (c) correspond to FIGS. 9, 11A, and 11B, respectively. In FIG. 13, (d) shows a temperature distribution of the recording material P obtained when the back face of the recording material P is cooled by the cooling roller 71*c*. As illustrated in (c) of FIG. 13, immediately after the recording material P passes the second cooling roller 71*b* to cool the front face of the recording material P, the temperature of the back face is lower than the toner solidification temperature and higher than the toner-adherence avoidance temperature at which blocking phenomenon is prevented. As a result, if the recording material P is discharged toward and slides against the lower conveyance guide plate 35, the toner image on the back face might be peeled off, thus causing the above-described failure. Hence, in this embodiment, the back face of the recording material P is cooled again by the cooling roller 71*c*. As illustrated in (d) of FIG. 13, the temperature of the back face of the recording material P is reduced to a temperature equal to or lower than the toner-adherence avoidance temperature at which blocking phenomenon is prevented. In such a state, the recording material P is fed to the lower conveyance guide plate 35, thus preventing the above-described failure. In (d) of FIG. 13, the front face is entirely heated to a temperature higher than a temperature shown at (c) of FIG. 13 by rebound of heat due to thermal diffusion within the recording material P. As a result, the temperature of the entire front face becomes higher than the back face and lower than the toner solidification temperature.

FIG. 14 is a graph of relationships among the positions of cooling rollers, the temperature of a front face of a recording material P (indicated by solid lines) and the temperature of a back face of the recording material P (indicated by broken lines) after the recording material P passes the fixing device.

In (a) of FIG. 14, the cooling rollers 71*a* and 71*b* are arranged within a predetermined space in an order of the pressing roller side and the fixing roller side in the recording-material transport direction. When the recording material P passes the first cooling roller 71*a*, the temperature of the back face greatly falls while the recording material P contacts the cooling roller 71*a*. Then, the temperature of the back face slightly rises. When the recording material P passes the second cooling roller 71*b*, the temperature of the back face slightly falls again due to a cooling effect from the front face. On the other hand, after the recording material P passes the first cooling roller 71*a*, the temperature of the front face slightly falls due to a cooling effect from the back face. When the recording material P passes the second cooling roller 71*b*, the temperature of the front face greatly falls. At this time, the temperature of the front face becomes lower than the back face. Then, the temperature of the front face slightly rises, and finally becomes the same temperature as the temperature of the back face over time.

In (b) of FIG. 14, the three cooling rollers 71*a*, 71*b*, and 71*c* are arranged within the predetermined space in an order of the pressing roller side, the fixing roller side, and the pressing roller side in the recording-material transport direction. Similarly with the above-described configuration, the temperature of the back face and the temperature of the front face repeat rise and fall. However, for this configuration, the rise and fall of temperature increases by a single set of rise and fall due to the third cooling roller 71*c*. In other words, the temperature of the back face greatly falls twice. Generally, when a cool material contacts a hot material, high cooling efficiency can be obtained. Accordingly, after the recording material P passes the second cooling roller 71*b*, the back face having a higher temperature is cooled by the third cooling roller 71*c*. Such a configuration can more efficiently reduce the temperature of the back face. In other words, in a configuration in which a third cooling roller is provided at the fixing roller side, the front face having a lower temperature is cooled by the third cooling roller. As a result, cooling efficiency is lower than the configuration in which the third cooling roller is provided at the pressing roller side.

Figure 15A:
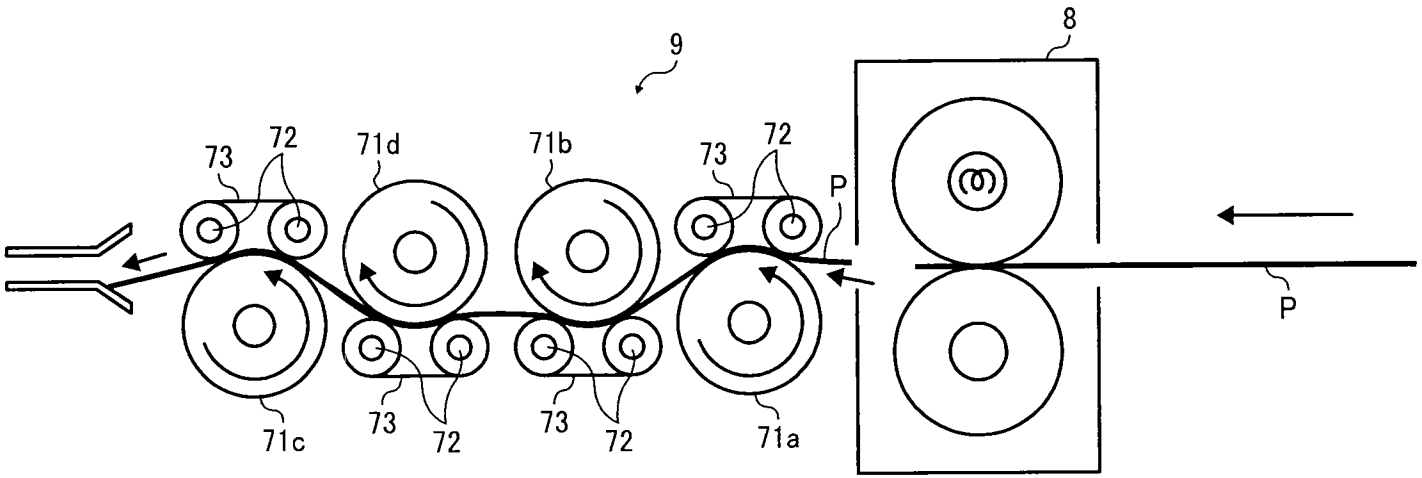
FIG. 15A is a front view of a recording-material cooling device according to an embodiment of this disclosure.
Figure 15B:
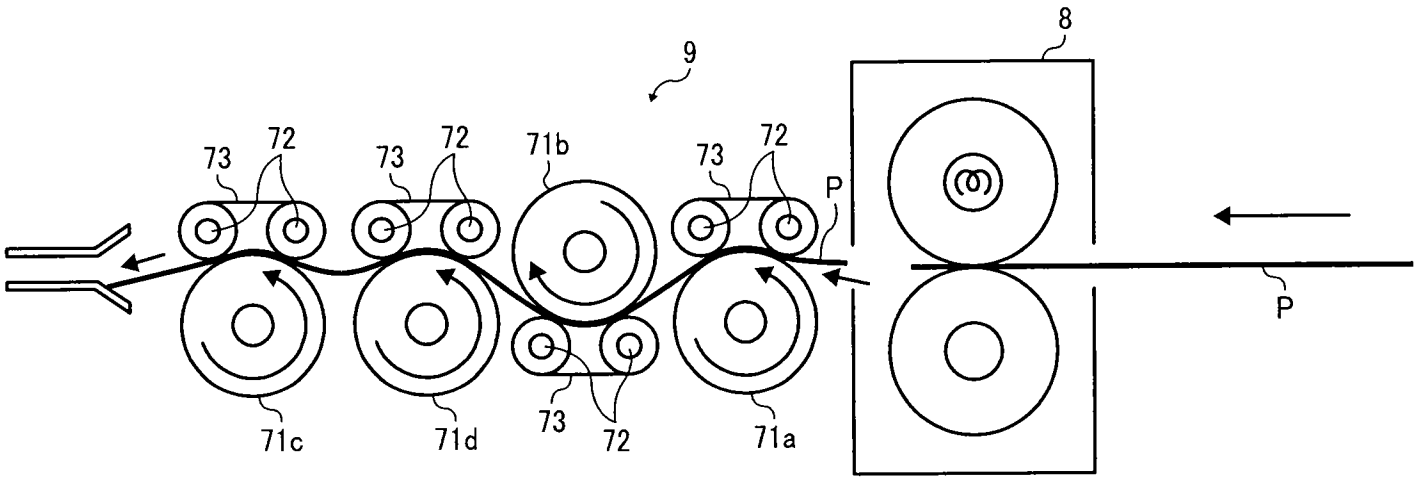
FIG. 15B is a front view of a recording-material cooling device according to an embodiment of this disclosure.

The cooling roller 71*c* disposed at the most downstream side of the cooling rollers 71 cools a higher temperature one of the front face and the back face of the recording material cooled by the cooling roller 71*b*. In this example, the cooling roller 71*c* is arranged to cool the back face. However, since the front face might have a higher temperature after cooling with the second cooling roller 71*b*, as illustrated in FIG. 15A, a cooling roller 71*d* serving as a fourth cooling unit may be disposed at a position between the cooling roller 71*b* and the cooling roller 71*c* at the same side as the fixing roller 17 relative to the recording material P. The cooling roller 71*d* cools a higher temperature one of the front face and the back face of the recording material P cooled by the cooling roller 71*b*. Accordingly, as illustrated in FIG. 15B, the cooling roller 71*d* may be disposed between the cooling roller 71*b* and the cooling roller 71*c* at the same side as the pressing roller 18 relative to the recording material P. Such advantage can be also obtained in the liquid-cooling heat sink illustrated in FIG. 3 or 4, a liquid-cooling heat sink illustrated in FIG. 17, the air-cooling heat sink illustrated in FIG. 5 and an air-cooling heat sink illustrated in FIG. 16.

Additionally, the three (or four) cooling rollers 71*a*, 71*b*, and 71*c* (and 71*d*) are arranged within the predetermined space, thus preventing an increase in the size of the recording-material cooling device.

Here, the cooling rollers as cooling members may be either an air cooling system or a liquid cooling system as described in the above-described embodiment. For the air cooling system, a cooling fan blows air into an interior of each cooling roller. For the liquid cooling system, cooling rollers include, for example, a cylindrical roller(s) made of, e.g., aluminum and serving as a cooling unit and an opposed roller(s) disposed opposing the cylindrical roller(s). The rollers include cooling-liquid channels through which cooling liquid flows. Such liquid-cooling-type cooling rollers are described in, for example, JP-2011-191502-A, and therefore detailed descriptions thereof are omitted here.

Figure 16:
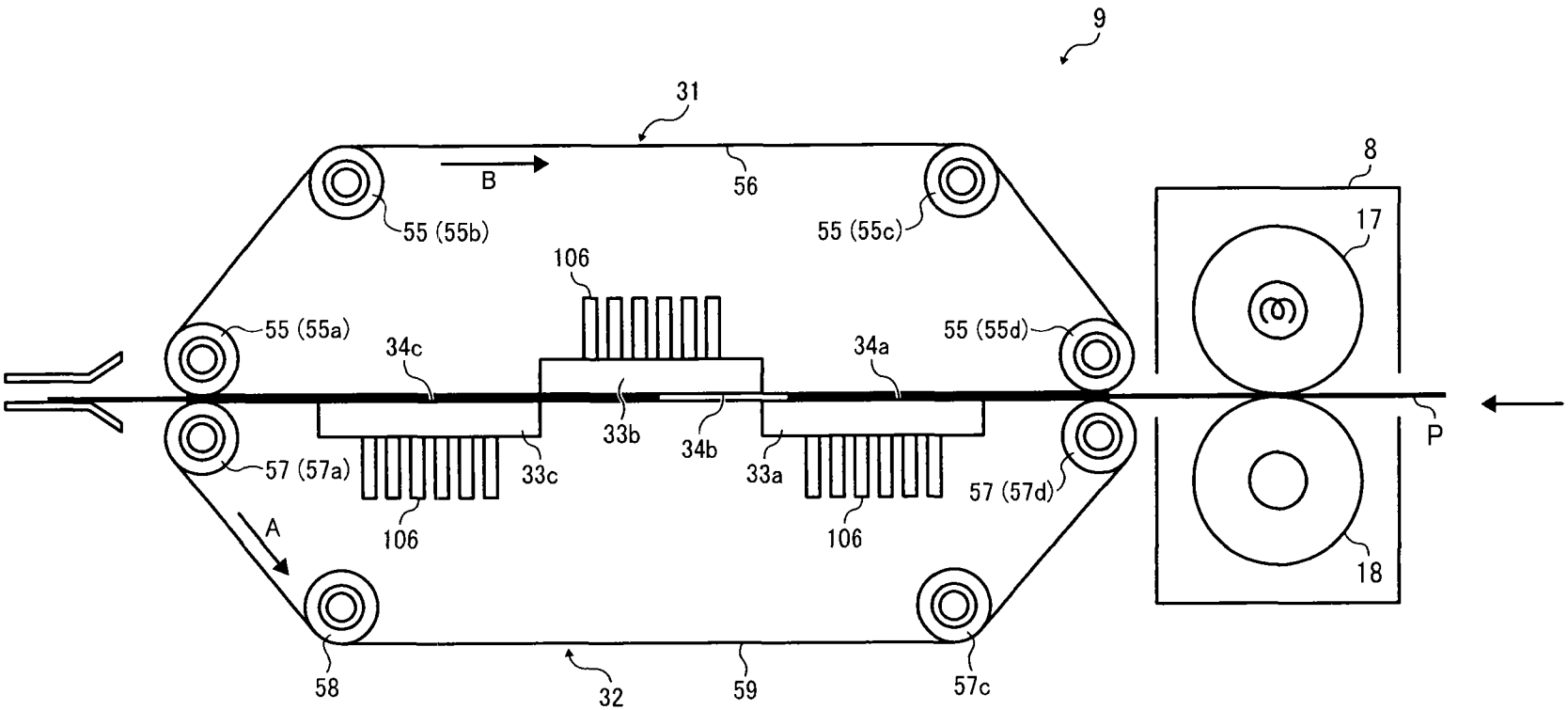
FIG. 16 is a front view of a recording-material cooling device according to an embodiment of this disclosure.

FIG. 16 is a front view of a configuration of a recording-material cooling device according to an embodiment of this disclosure.

In a recording-material cooling device 9 according to this embodiment, a fixing device 8 fixes a toner image on a front face of a recording material P under heat. The recording material P heated to a high temperature by the fixing device 8 is sandwiched and conveyed with a first conveyance assembly 31 and a second conveyance assembly 32. The first conveyance assembly 31 includes a plurality of rollers 55 (55*a* to 55*d*) and a belt 56 rotatably stretched over the rollers 55. The second conveyance assembly 32 includes a plurality of rollers 57 (57*a*, 57*c* and 57*d*) and 58 and a belt 59 rotatably stretched over the rollers 57 and 58. In this conveyance, heat of the recording material P is alternately absorbed from the back face and the front face via the belts 56 and 59 by air-cooling heat sinks 33*a*, 33*b* and 33*c* serving as first, second, and third cooling units contacting inner circumferential surfaces of the belts 56 and 59. As a result, the recording material P is cooled and discharged at a low temperature. The recording-material cooling device 9 has the air-cooling heat sink 33*a*, the air-cooling heat sink 33*b*, and the air-cooling heat sink 33*c* in the recording-material transport direction. The air-cooling heat sink 33*a* serving as the first cooling unit is disposed at the same side as a pressing roller 18 relative to the recording material P conveyed. The air-cooling heat sink 33*b* serving as the second cooling unit is disposed at the same side as a fixing roller 17 relative to the recording material P conveyed. The air-cooling heat sink 33*c* serving as the third cooling unit is disposed at the same side as the pressing roller 18 relative to the recording material P conveyed. In this example, heat absorbing surfaces (heat receiving surfaces) are flat unlike the air cooling heat sinks illustrated in FIG. 5.

The recording-material cooling device according to this embodiment can obtain a greater heat receiving area at a similar apparatus size than the above-described recording-material cooling device employing the cooling rollers, thus obtaining high cooling effect in a saved space. In addition, the air-cooling heat sinks are alternately disposed at the back face side and the front face side of a recording material P. Such a configuration can obtain a higher cooling efficiency than a configuration in which the recording material is cooled from only a single face side, and a lower resistance in belt conveyance than a configuration in which the recording material P is sandwiched with and cooled from both the front face and the back face. In this embodiment, a lower face of the air-cooling heat sink 33*b* serving as the second cooling unit is a flat heat absorbing surface 34*b*, and upper faces of the air-cooling heat sinks 33*a* and 33*c* serving as the first and third cooling units are heat absorbing surfaces 34*a* and 34*c*, respectively. The other configurations are similar to, if not the same as, those of the above-described embodiment. As described above, in this embodiment, the air-cooling heat sinks are arranged in the order of the pressing roller side, the fixing roller side, and the pressing roller side in the recording-material transport direction to cool a recording material P in an order of the back face, the front face, and the back face. Such a configuration can prevent adherence of toner to the lower conveyance guide plate 35 or occurrence of image flaws while reliably preventing occurrence of uneven brightness of a toner image on the back face in duplex printing.

Figure 17:
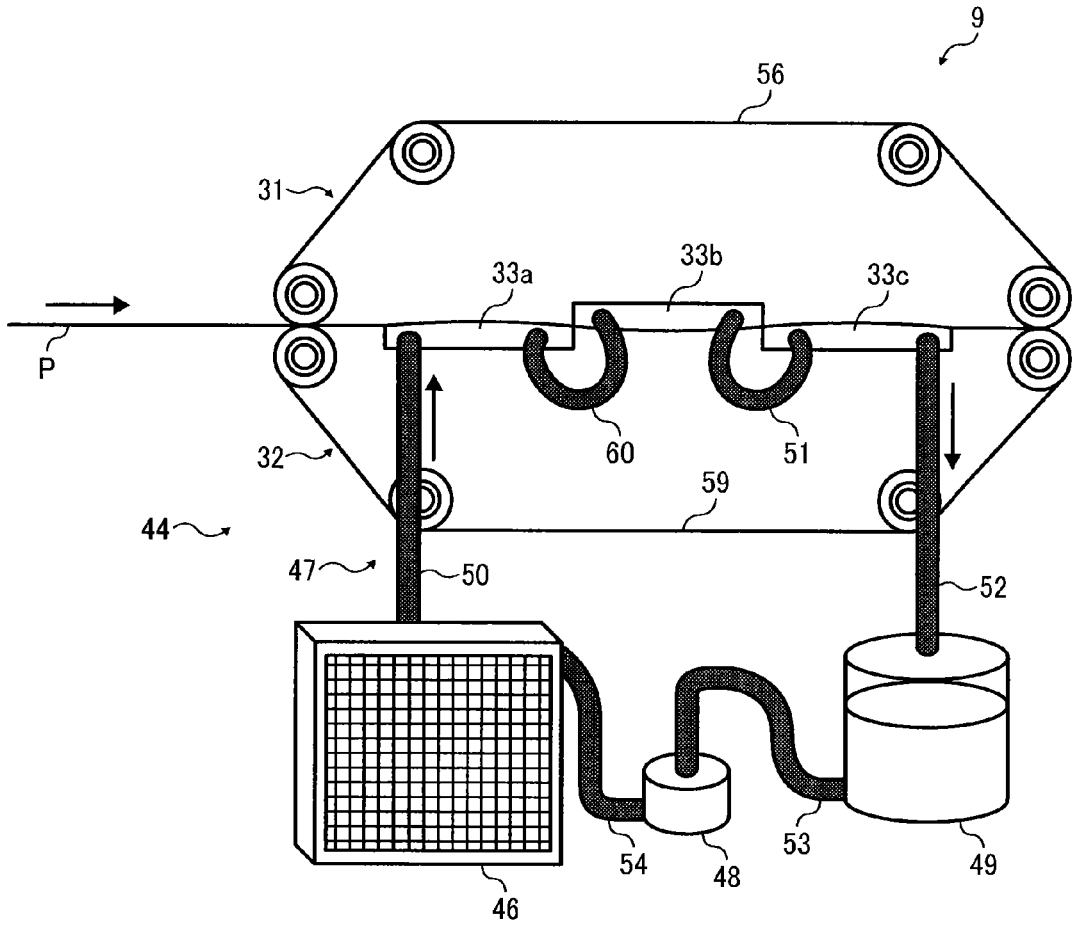
FIG. 17 is a back view of a recording-material cooling device according to an embodiment of this disclosure.

FIG. 17 is a back view of a recording-material cooling device 9 according to an embodiment of this disclosure.

The recording-material cooling device 9 according to this embodiment is a liquid-cooling-type recording-material cooling device having a higher cooling performance than a recording-material cooling device employing air-cooling heat sinks. For this embodiment, the relative positions of a radiator 46 serving as a heat dissipating part and a liquid tank 49 are opposite to those of FIG. 4. In other words, a pipe 50 connects an opening of a cooling member 33*a* to the radiator serving as the heat dissipating part 46. A pipe 52 connects an opening of the cooling member 33*c* to the liquid tank 49. The other configurations are similar to, if not the same as, those of the above-described embodiment of FIG. 4. A cooling liquid stored in the liquid tank 49 is fed with a pump 48 so as to pass the radiator 46 and radiate heat to ambient atmosphere. As a result, the temperature of the cooling liquid falls. The cooling liquid thus cooled to a low temperature passes the cooling members 33*a*, 33*b*, and 33*c* in turn and absorbs heat from the cooling members 33*a*, 33*b*, and 33*c* via thermal transfer. As a result, the cooling liquid having a high temperature returns to the liquid tank 49.

For the recording-material cooling device 9, the cooling member 33*a*, through which the cooling liquid discharged at a lowest temperature from the heat dissipating part 46 first passes, has a highest cooling performance of the cooling members 33*a*, 33*b*, and 33*c*. As a result, the cooling liquid discharged from the heat dissipating part 46 passes the cooling member 33*a*, the cooling member 33*b*, and the cooling member 33*c* in this order. Such a configuration allows the cooling member 33*a* disposed at an entry side of the recording material P to reliably reduce the temperature of a toner image on the back face of the recording material P to a temperature equal to or lower than a toner solidification temperature.

Typically, the lower the temperature of the cooling member 33*c* disposed at a most downstream side in the recording-material transport direction to cool the recording material P lastly, the lower the temperature of the recording material P discharged. Accordingly, for the recording-material cooling device illustrated in FIG. 4, the cooling liquid discharged from the heat dissipating part 46 passes the cooling member 33*c*, the cooling member 33*b*, and the cooling member 33*a* in this order. However, it is to be noted that any other suitable piping can be employed to an extent that uneven brightness of a toner image on the back face of the recording material P or image flaws by and adherence of toner to the lower conveyance guide plate 35 can be prevented.

In the above-described embodiments, the cooling members 33 of the belt-type recording-material cooling device are not limited to the air-cooling heat sinks or liquid cooling plates but may be, for example, cooling members employing Peltier elements, or cooling plates in which heat absorbing ends of heat pipes having radiating ends are embedded.

The sheet output unit is not limited to the output tray 20 on which recording materials P are stacked, but may be, for example, a post-processing device to post-process a recording material P discharged.

Alternatively, for example, the heat absorbing surfaces 34*a*, 34*b*, and 34*c* illustrated in FIG. 3 may be shaped flat.

In the recording-material cooling device 9 illustrated in, e.g., FIG. 3, 5, 12, or 16, the number of cooling units disposed at the pressing roller side is greater than the number of cooling units disposed at the fixing roller side. This means that the total amount of heat absorbed from a recording material by the cooling units at the pressing roller side is greater than the total amount of heat absorbed from a recording material by the cooling units at the fixing roller side.

Figure 18:
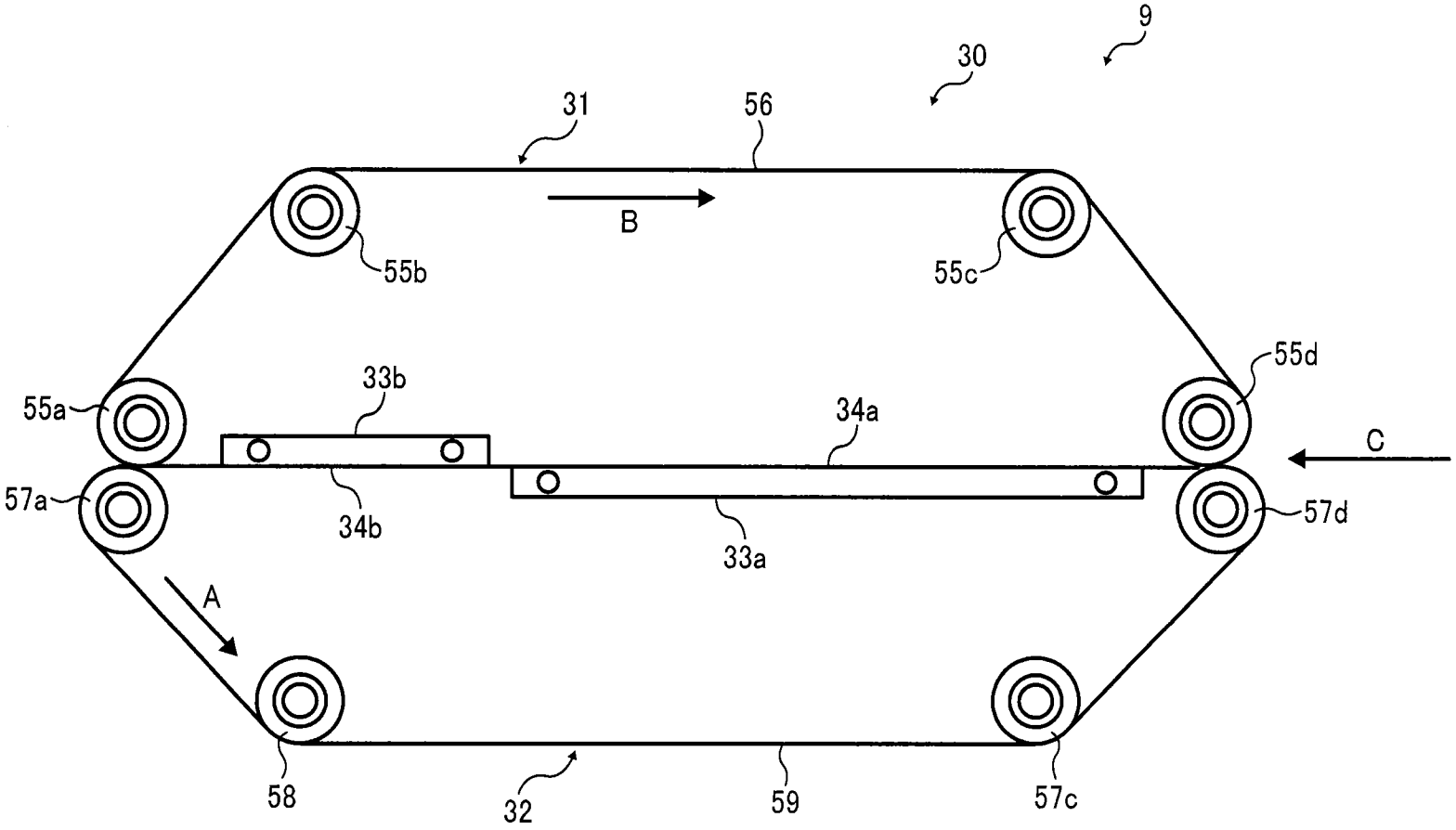
FIG. 18 is a front view of a recording-material cooling device according to an embodiment of this disclosure.

Therefore, if the cooling units satisfy the relation between the total heat amounts, the number of cooling units at the pressing roller side may be the same as the number of cooling units at the fixing roller side. In such a case, as illustrated in FIG. 18, the breadth (length in a recording-material transport direction indicated by arrow C) of the heat absorbing surface 34*a* of the cooling member 33*a* is set to be greater than the breadth (length in the recording-material transport direction C) of the heat absorbing surface 34*b* of the cooling member 33*b*. For example, the breadth of the heat absorbing surface

34*a* is preferably set to be three times or more as broad as the breadth of the heat absorbing surface 34*b*.

For such a configuration, immediately after a recording material P passes the first cooling member 33*a* that cools the back face of the recording material P, the temperature of the back face can be reduced to a temperature significantly lower than the toner adherence avoidance temperature, and the temperature of the front face can be raised to a temperature higher than the toner adherence avoidance temperature at which blocking phenomenon does not occur but lower than the toner solidification temperature. Then, after the recording material P passes the second cooling member 33*b* that cools the front face of the recording material P, as illustrated in (d) of FIG. 13, both the temperature of the front face and the temperature of the back face can be reliably reduced to temperatures lower than the toner adherence avoidance temperature. As described above, in the configuration in which the breadth of the heat absorbing surface 34*a* is greater than the breadth of the heat absorbing surface 34*b*, the back face of the recording material P can be cooled in advance with the heat absorbing surface 34*a* so that the temperature of the front face and the temperature of the back face become lower than the toner adherence avoidance temperature even if heat of the front side of the recording material P is transferred to the back side when the heat absorbing surface 34*b* absorbs heat from the front face.

Alternatively, instead of the configuration illustrated in FIG. 18, a plurality of cooling members 33*a* may be arranged along the recording-material transport direction C by the length of the cooling member 33*a* illustrated in FIG. 18.

Figure 19:
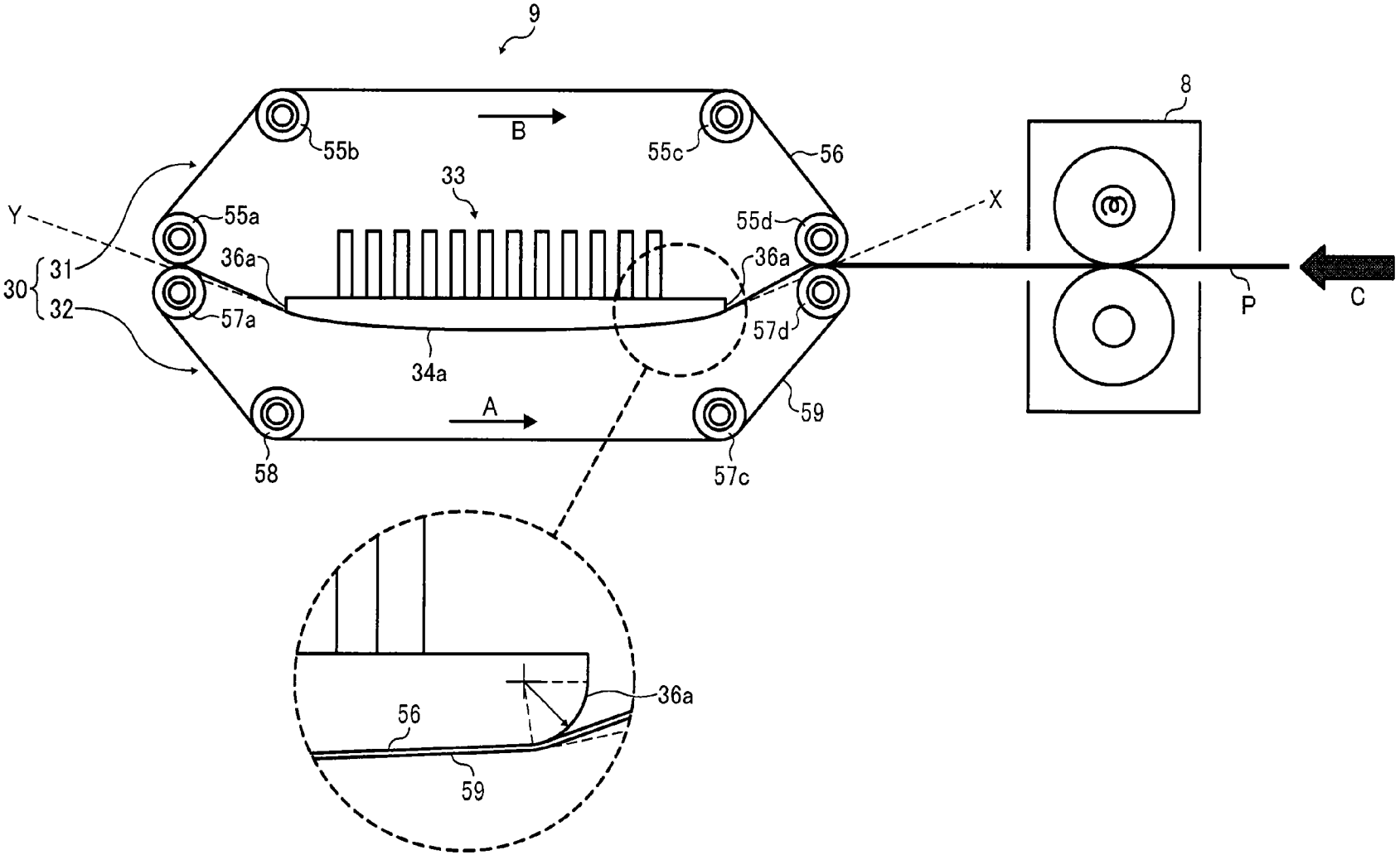
FIG. 19 is a schematic front sectional view of a recording-material cooling device according to an embodiment of this disclosure.

FIG. 19 is a schematic front sectional view of a recording-material cooling device according to an embodiment of this disclosure.

As illustrated in FIG. 19, a recording-material cooling device 9 according to this embodiment includes a belt conveyance unit 30 and a cooling member 33 to contact an inner circumferential surface of a belt 56 to cool a recording material P transported by traveling of the belt 56 and a belt 59 of the belt conveyance unit 30. In this embodiment, the cooling member 33 is an air-cooling heat sink. The belt conveyance unit 30 includes a first conveyance assembly 31 and a second conveyance assembly 32. The first conveyance assembly 31 is disposed at one face side (front face side or upper face side) of the recording material P. The second conveyance assembly 32 is disposed at the other face side (back face side or lower face side) of the recording material P. In the first conveyance assembly 31, the belt 56 serving as a belt member is rotatably held by and stretched over a plurality of rollers 55 serving as stretching members. In the second conveyance assembly 32, the belt 59 serving as a belt member is rotatably held by and stretched over a plurality of rollers 57 (57*a*, 57*c*, and 57*d*) and 58 serving as stretching members. The cooling member 33 is disposed in contact with the inner circumferential surface of the belt, 56 at the one face side (front face side or upper face side) of the recording material P.

As illustrated in FIG. 19, the first conveyance assembly 31 includes the plurality of rollers 55 (e.g., four driven rollers 55*a*, 55*b*, 55*c*, 55*d* in FIG. 19) and the belt (conveyance belt) 56 wound around the plurality of rollers 55. The second conveyance assembly 32 includes, as the plurality of rollers 57 and 58, a plurality of driven rollers 57*c*, 57*d*, 58, and a driving roller 57*a*, and the belt (conveyance belt) 59 wound around the driving roller 57*a* and the plurality of driven rollers 57*c*, 57*d*, and 58.

Accordingly, after a recording material P is heated to high temperature when the fixing device 8 fixes a toner image on the front face of the recording material P, the belt 56 of the first conveyance assembly 31 and the belt 59 of the second conveyance assembly 32 convey the recording material P while sandwiching the recording material P. In other words, as illustrated in FIG. 19, the belt 59 is traveled in a direction indicated by arrow A by driving the driving roller 57*a*. With travel of the belt 59, the belt 56 of the first conveyance assembly 31 is traveled in a direction indicated by arrow B via the recording material P sandwiched between the belts 56 and 59. Thus, the recording material P is conveyed from an upstream side to a downstream side in a transport direction indicated by arrow C in FIG. 19. In this conveyance, the cooling member 33 slidingly contacts the inner circumferential surface of the belt 56 and absorbs heat of the recording material P via the belt 56. As a result, the recording material P is cooled and discharged at low temperature.

The cooling member 33 is fixed to a frame of the recording-material cooling device 9. Both when the belts 56 and 59 are rotated without conveying a recording material P and when the belts 56 and 59 convey a recording material P while sandwiching the recording material P, tension is applied to the belts 56 and 59 at equivalent strengths enough to prevent a slack from occurring between adjacent rollers of the plurality of rollers 55, 57, and 58.

In this embodiment, a main heat absorbing surface 34*a* of the cooling member 33 has a curved surface shape. In an assembled state illustrated in FIG. 19, the belt 56 closely contacts at least the main heat absorbing surface 34*a* of the cooling member 33 by tension. At each end of the cooling member 33 in the recording-material transport direction C, an auxiliary heat absorbing surface 36*a* is disposed adjacent to the main heat absorbing surface 34*a*. The auxiliary heat absorbing surface 36*a* has a curved surface of a smaller curvature radius than the main heat absorbing surface 34*a*. In FIG. 19, tangent lines X and Y are tangent lines at border points BP (see FIG. 20) between the main heat absorbing surface 34*a* and the auxiliary heat absorbing surface 36*a*. Before a recording material P is conveyed, rotation trajectories of the belts 56 and 59 between the cooling member 33 and the roller 55*a* or 55*d* adjacent to the cooling member 33 pass a route deviated toward the cooling member 33 (upward) from each of the tangent line X and Y at the border points. At this time, the belt 56 contacting the cooling member 33 contacts a portion of the auxiliary heat absorbing surface 36*a*.

By providing the auxiliary heat absorbing surface 36*a*, the belt 56 is strongly stretched downward by the cooling member 33 when the upper belt 56 and the lower belt 59 are closed in the assembled state to sandwich and convey a recording material P. As a result, the tension of the belt 56 is maintained to be high, allowing the belt 56 to contact the auxiliary heat absorbing surface 36*a* at a front side and a rear side of the recording-material cooling device 9. Accordingly, even if the tension of the belt 56 is deviated by, e.g., deflection of the belt, the belt 56 can contact the main heat absorbing surface 34*a* or both the main heat absorbing surface 34*a* and the auxiliary heat absorbing surface 36*a* at the front side and the rear side of the recording-material cooling device 9. Thus, the heat absorbing surface of the cooling member is effectively used, thus obtaining a high degree of cooling effect. Providing the auxiliary heat absorbing surface 36*a* can also prevent rapid wearing of the belts which could be caused when both edges of the main heat absorbing surface 34*a* are angular. The cooling member 33 having the main heat absorbing surface 34*a* and the auxiliary heat absorbing surface 36*a* is produced as a single component by injection molding from a mold having such a shape.

When a leading end of a recording material P (e.g., a thick sheet of paper) conveyed approaches the auxiliary heat absorbing surface 36*a* or the main heat absorbing surface 34*a*, the belt 56 is moved to an upper position than a position illustrated in FIG. 19 and the belt 59 is moved to a lower position than a position illustrated in FIG. 19. At this time, the belt 59 matches the tangent line X or is placed at an upper position than the tangent line X. The same is also applied to the tangent line Y at an exit portion.

Figure 20:
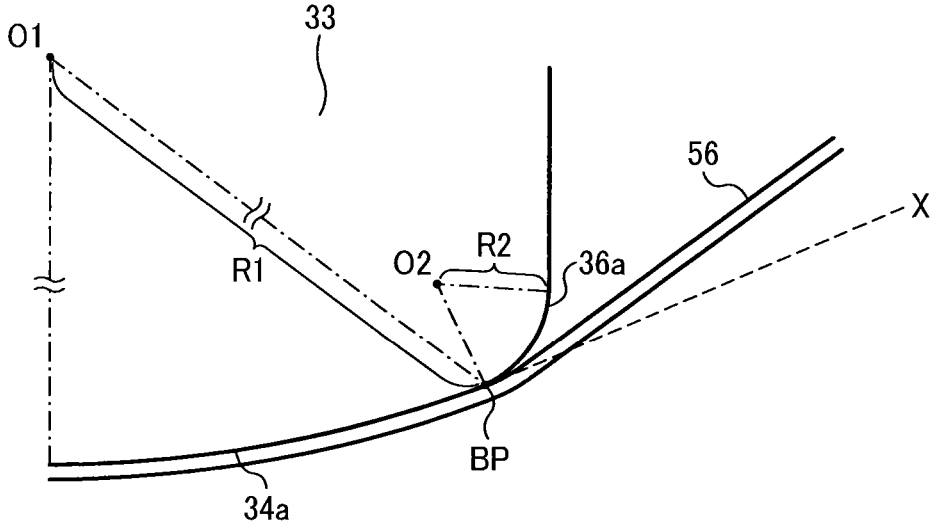
FIG. 20 is an enlarged view of an end portion of a cooling member of the recording-material cooling device illustrated in FIG. 19.

FIG. 20 is an enlarged view of an end portion of the cooling member 33 in this embodiment.

As illustrated in FIG. 20, the main heat absorbing surface 34*a* is a surface having a curvature radius R1 around a virtual center O1, and the auxiliary heat absorbing surface 36*a* is a surface having a curvature radius R2 around a virtual center O2 (R1>R2). For example, R1 is 1600 mm and R2 is 5 mm.

Figure 21:
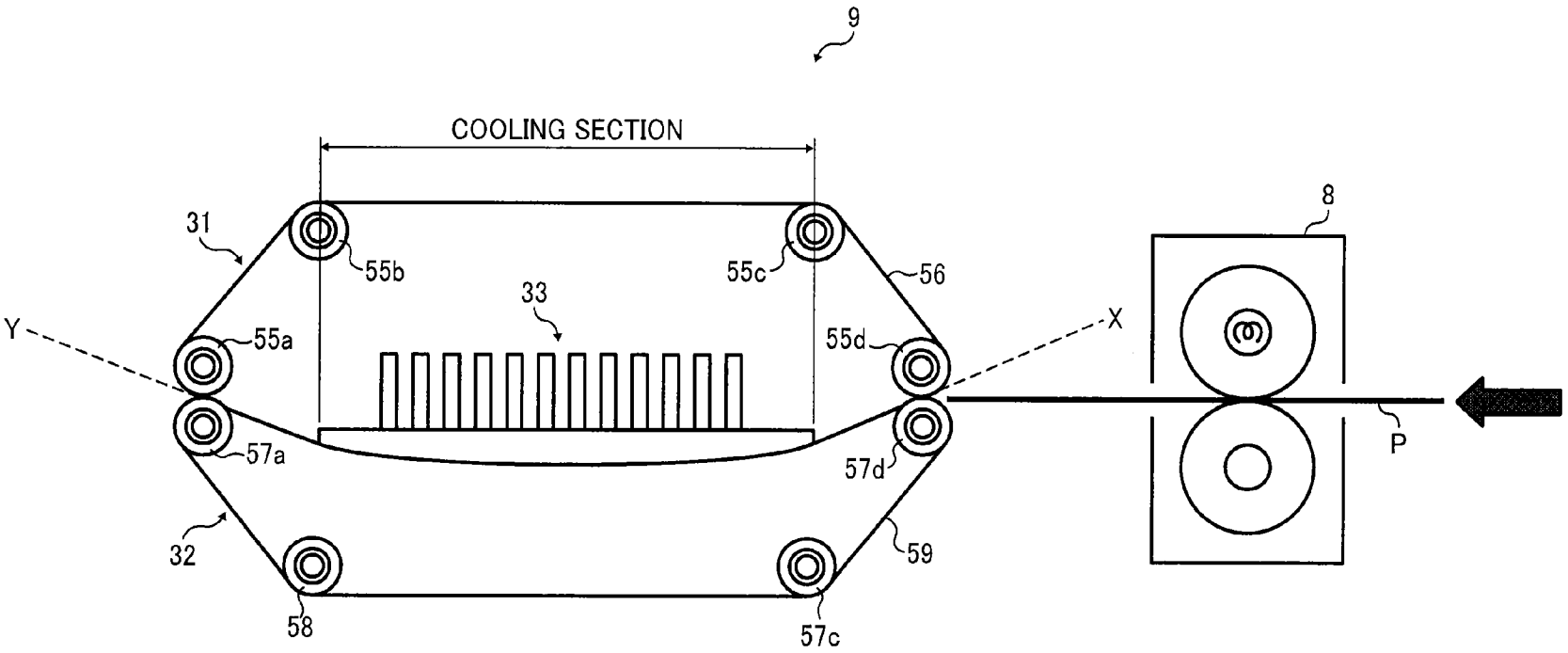
FIG. 21 is a schematic front sectional view of a recording-material cooling device according to a comparative example 1.

FIG. 21 is a schematic front sectional view of a recording-material cooling device according to a comparative example 1.

In the comparative example 1, a recording-material cooling device 9 is configured so that rotation trajectories of belts 56 and 59 between a cooling member 33 and a roller 55*a* or 55*d* adjacent to the cooling member 33 coincide tangent lines X and Y at end points of a heat absorbing surface of the cooling member 33. In such a configuration, the belt 56 contacts the entire heat absorbing surface of the cooling member 33 so that a cooling section can be obtained from end to end of the cooling member 33. However, if a deviation arises in the tension of the belt 56 as described above, the belt 56 might not contact the heat absorbing surface at the front side and the rear side of the recording-material cooling device 9.

Figure 22:
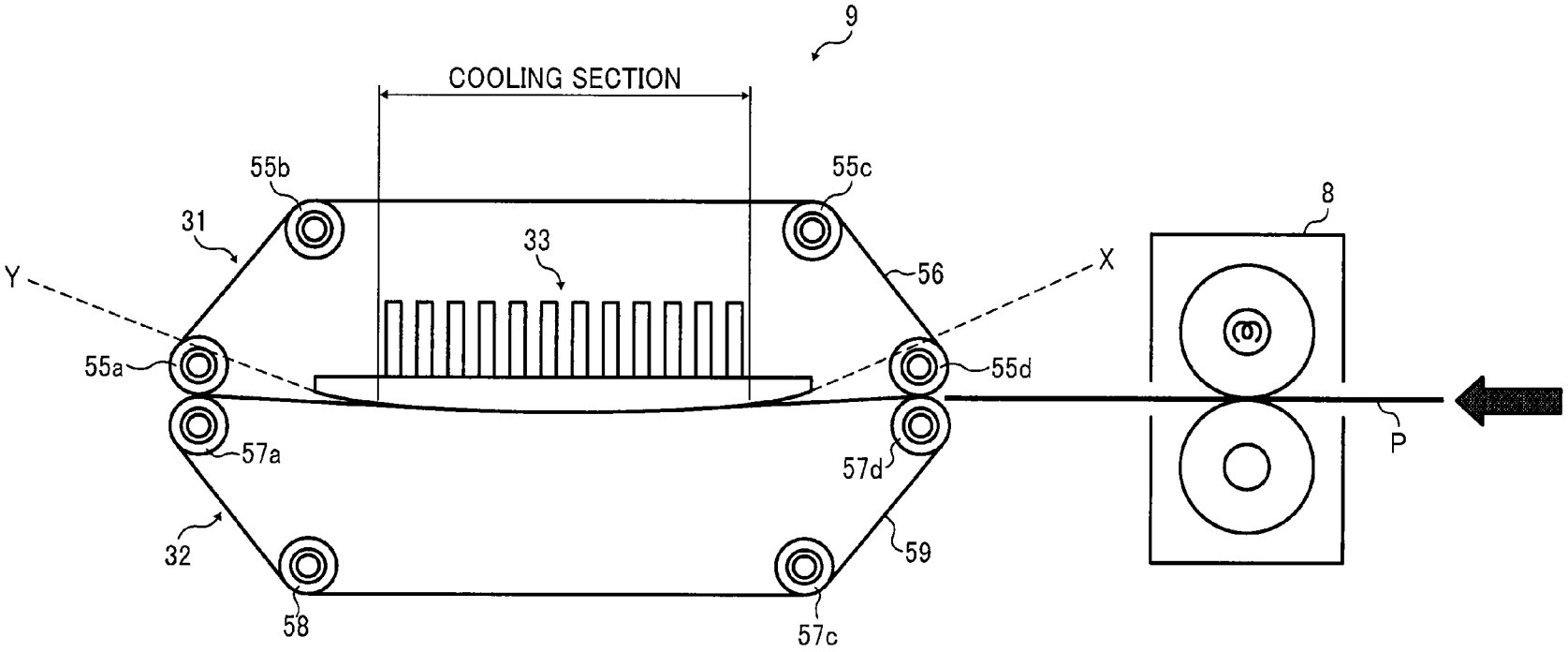
FIG. 22 is a schematic front sectional view of a recording-material cooling device according to a comparative example 2.

FIG. 22 is a schematic front sectional view of a recording-material cooling device according to a comparative example 2.

In the comparative example 2, a recording-material cooling device 9 is configured so that rotation trajectories of belts 56 and 59 between a cooling member 33 and a roller 55*a* or 55*d* adjacent to the cooling member 33 pass below tangent lines X and Y at end points of a heat absorbing surface of the cooling member 33. In such a configuration, the belt 56 does not constantly contact end portions of the heat absorbing surface of the cooling member 33, thus reducing a cooling section used for cooling. Accordingly, the time in which heat of the recording material P conveyed is absorbed becomes shorter by the reduction of the cooling section, thus preventing effective use of the heat absorbing surface of the cooling member 33. As a result, a high degree of cooling effect cannot be obtained. By contrast, for the configuration according to this embodiment, the entire heat absorbing surface 34*a* of the cooling member 33 can effectively be used, thus allowing the recording material P to be sufficiently cooled via the belt 56. In addition, the configuration according to this embodiment prevents occurrence of a useless space which is not used as the cooling section, thus allowing space saving.

Figure 23:
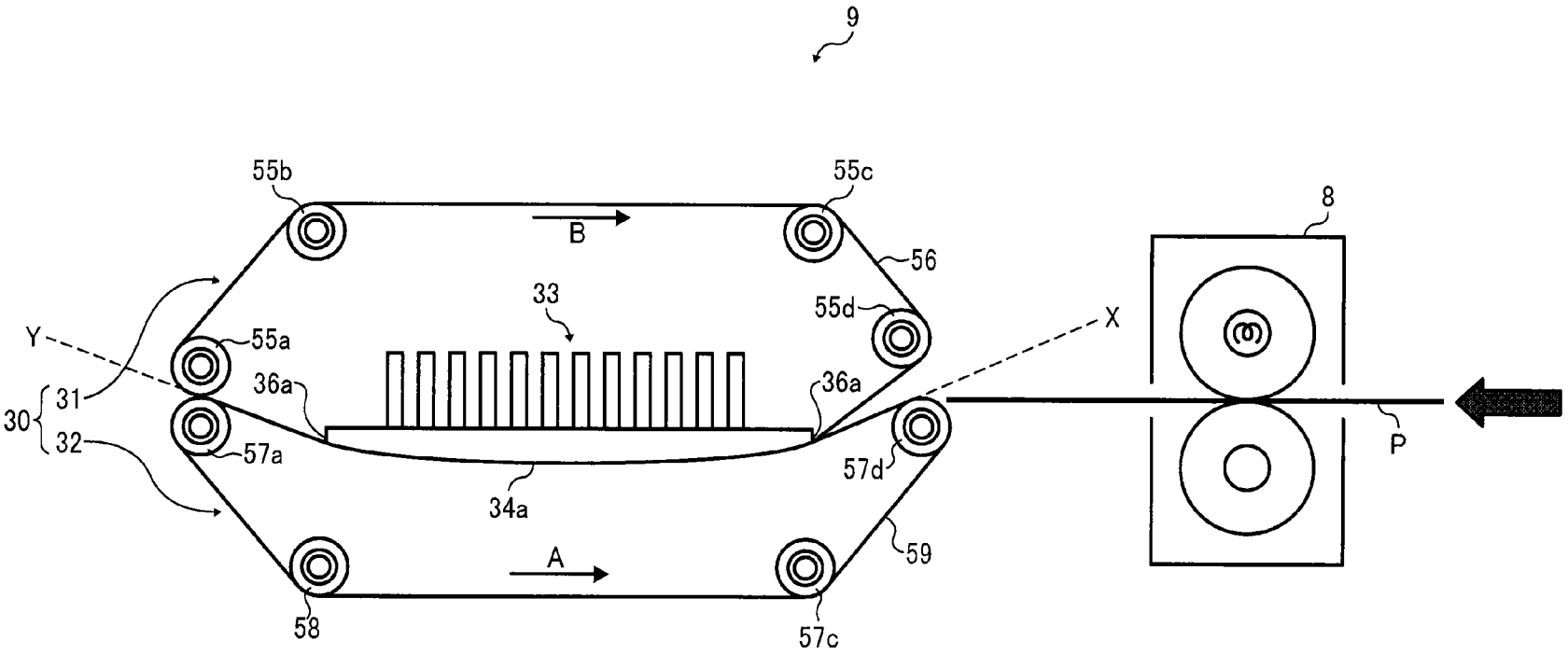
FIG. 23 is a schematic front sectional view of a recording-material cooling device according to an embodiment of this disclosure.

FIG. 23 is a schematic front sectional view of a recording-material cooling device according to an embodiment of this disclosure.

For a recording-material cooling device 9 according to this embodiment, between a cooling member 33 at an entry side of a recording material P and each of a roller 55*d* and a roller 57*d*, a belt 56 passes a route deviated toward the cooling member 33 (upward) from a tangent line X at a border point between a main heat absorbing surface 34*a* and an auxiliary heat absorbing surface 36*a*. The belt 59 passes on the tangent line X or a route deviated toward the cooling member 33 (upward) from the tangent line X. Rotation trajectories of the belts 56 and 59 are not parallel to each other. A clearance arises between the belts 56 and 59, and the rotation trajectory of the belt 56 is more acute than the rotation trajectory of the belt 59.

For such a configuration of the belts 56 and 59, the belt 56 does not contact a toner image on a recording material P until the belt 56 arrives at a cooling start point at which the main heat absorbing surface 34*a* or the auxiliary heat absorbing surface 36*a* of the cooling member 33 starts cooling the belt 56, thus preventing adherence of toner to the belt 56. In other words, immediately after a recording material P passes the fixing device 8, a toner image on the recording material P is in a semi-melted state. When, e.g., a conveyance member contacts the semi-melted toner image, toner may be transferred to and adheres to the conveyance member. If such adhering toner stacks on the conveyance member, the stacked toner might damage an image on a recording material which subsequently passes the conveyance member or hamper conveyance of the recording material. When a toner image is sufficiently cooled while contacting the conveyance member, solidified at a low temperature, and separated from the conveyance member, such toner adherence can be prevented.

By contrast, since the recording material is already cooled at an exit side, the rotation trajectories of the belts 56 and 59 substantially coincide a tangent line Y. Alternatively, the rotation trajectories of the belts 56 and 59 may be configured to pass a route deviated toward the cooling member 33 (upward) from the tangent line Y.

Figure 24:
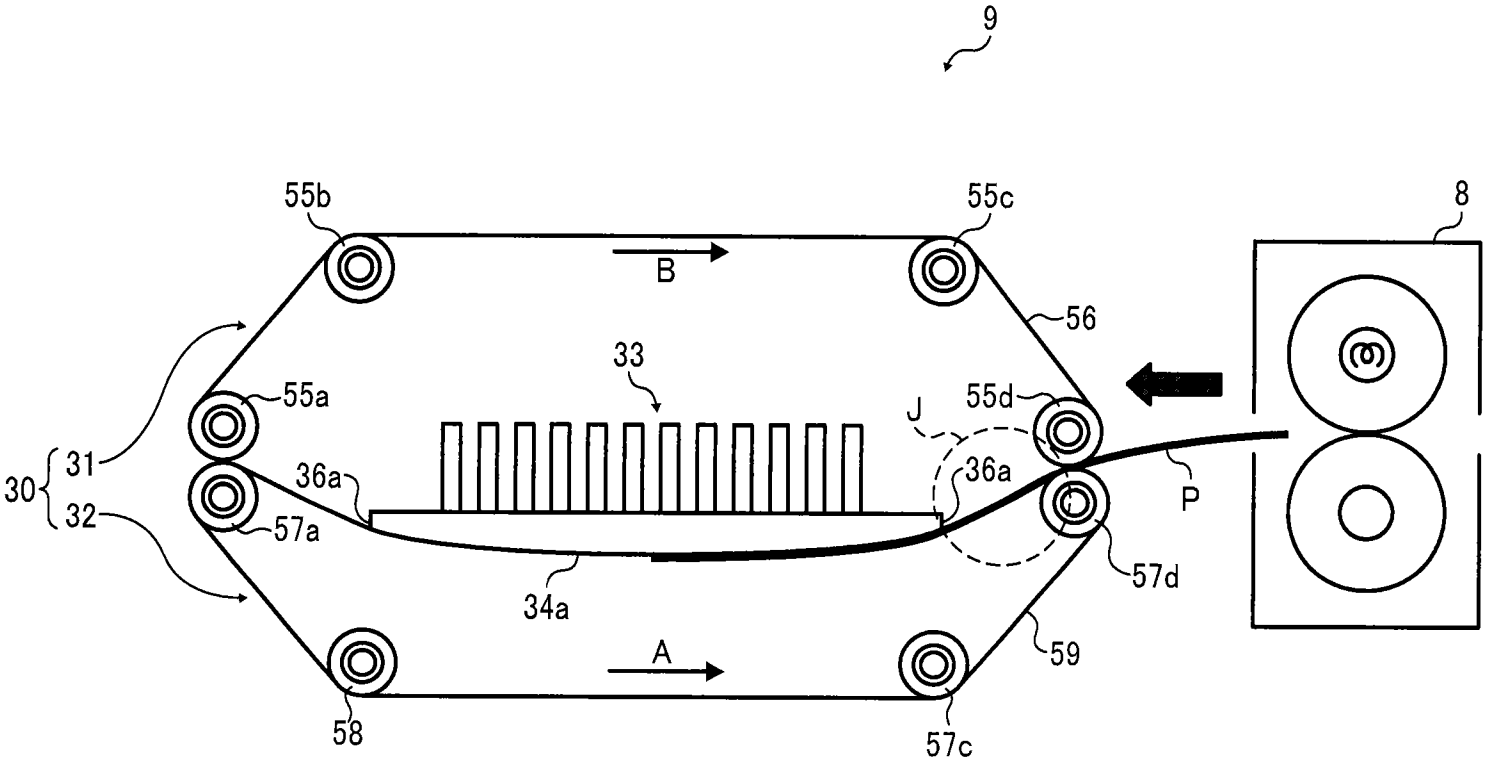
FIG. 24 is a schematic front sectional view of a recording-material cooling device according to the comparative example illustrated in FIG. 21.

FIG. 24 is another schematic front sectional view of the recording-material cooling device 9 illustrated in FIG. 21 in a state in which a recording material enters the recording-material cooling device.

In FIG. 24, a recording material P enters the recording-material cooling device 9 in which the belts 56 and 59 are arranged in parallel to each other. At this time, if an image forming apparatus including the recording-material cooling device 9 urgently stops due to, e.g., a paper jam, toner on a front face side of the recording material P is cooled at a portion of the recording material P contacting the cooling member 33 via the belt 56. Accordingly, when a user or a service person manually removes the recording material P later, adhering toner does not remain on the belt 56. However, in an area J demarcated by a broken line between the cooling member 33 and the roller 55*d* or 57*d*, the recording material P is in contact with only the belt 56. As a result, a toner image is not cooled. Accordingly, until the recording material P is removed, a toner image heated to high temperature contacts and remains on the belt 56. As a result, toner might adhere to the belt 56.

Figure 25:
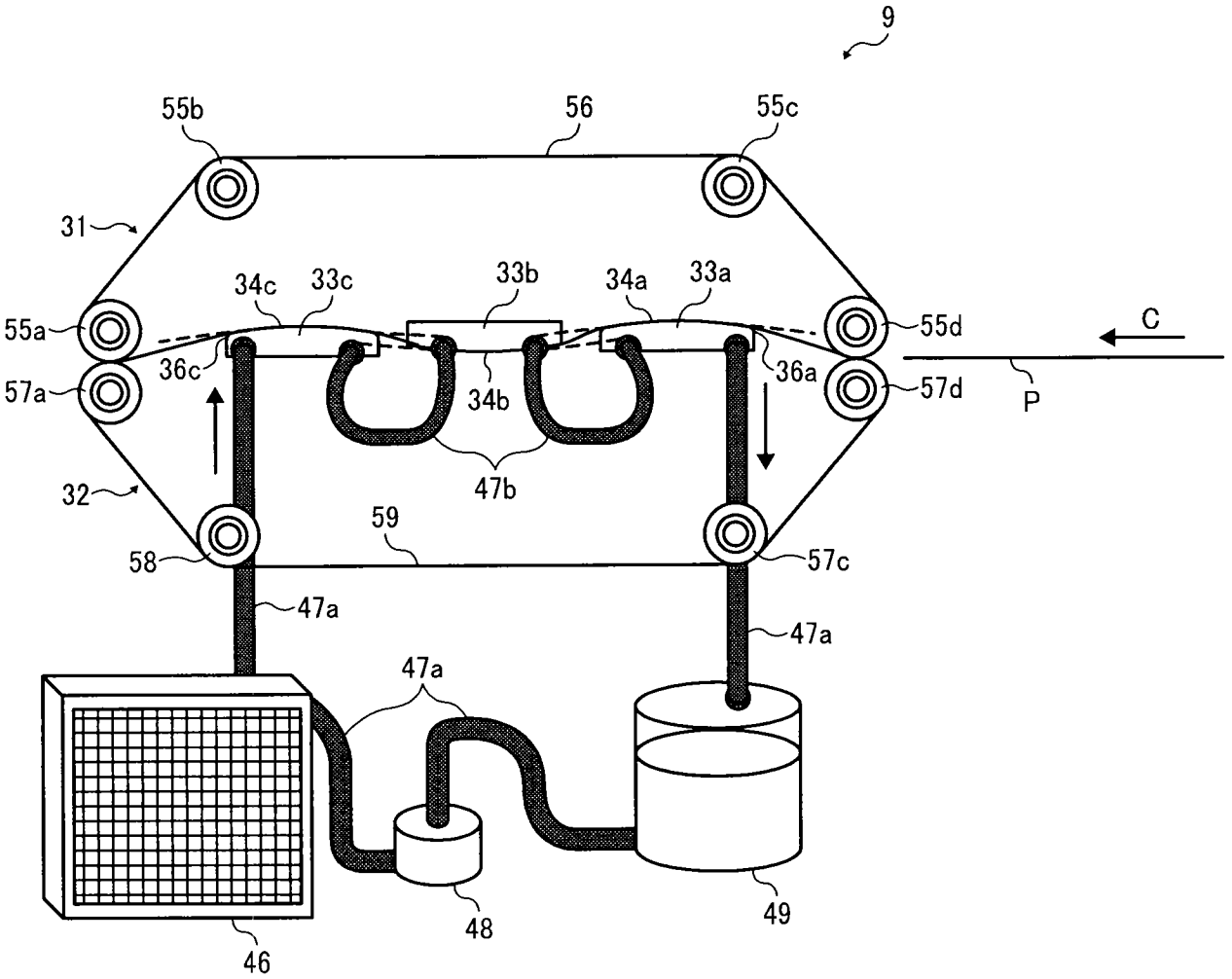
FIG. 25 is a schematic back sectional view of a recording-material cooling device according to an embodiment of this disclosure.

FIG. 25 is a schematic back sectional view of a recording-material cooling device according to an embodiment of this disclosure.

In this embodiment, cooling members 33 (33*a*, 33*b*, 33*c*) are liquid cooling plates having a higher cooling performance than air-cooling heat sinks. The three cooling members 33*a*, 33*b*, and 33*c* are alternately arranged in an order of a lower side, an upper side, and a lower side of a conveyed recording material in a recording-material transport direction indicated by arrow C in FIG. 25. Adjacent cooling members of the cooling members 33*a*, 33*b*, and 33*c* are arranged to partially overlap each other in a thickness direction (top-and-bottom direction in FIG. 25) of the cooling members 33*a*, 33*b*, and 33*c*. The thickness direction used herein can also be referred to as a direction crossing or perpendicular to the recording-material transport direction C at a center (top) of each of a main heat absorbing surface 34*a*, a main heat absorbing surface 34*b*, and a main heat absorbing surface 34*c*.

Each of the cooling members 33*a*, 33*b*, and 33*c* includes a channel through which cooling liquid passes. The cooling liquid transfers an amount of heat absorbed from the heat absorbing surfaces 34*a*, 34*b*, and 34*c* to the outside. As a result, the cooling members 33*a*, 33*b*, and 33*c* are maintained at low temperatures. The cooling liquid is stored in a liquid tank 49, and fed by a pump 48. Then, the cooling liquid passes through a radiator 46 to radiate heat to outside air, thus reducing the temperature thereof. The cooling liquid thus cooled to low temperature passes the cooling members 33*c*, 33*b*, and 33*a* in turn and absorbs heat from the cooling members 33*c*, 33*b*, and 33*a* by thermal transfer. As a result, the cooling liquid having high temperature returns to the liquid tank 49. The three cooling member 33*a*, 33*b*, and 33*c* are connected via flexible rubber tubes 47*b*. Accordingly, for example, when a paper jam occurs in a conveyance route between a first conveyance assembly 31 and a second conveyance assembly 32, the first conveyance assembly 31 and the second conveyance assembly 32 are separated from each other along with the cooling member 33*b* (by a separation unit), thus allowing a jammed sheet to be removed. Other components are connected via metal pipes 47*a* which are less subject to liquid leakage due to tear or damage.

By arranging the cooling members 33 alternately at the upper side and the lower side relative to the recording material P, heat of the recording material can be absorbed from both the front face side and the back face side of the recording material, thus allowing efficient absorption of a heat amount accumulated in the recording material. In this embodiment, before the recording material P is conveyed, the rotation trajectories of the belts 56 and 59 between the cooling member 33*a* and the rollers 55*d* and 57*d* pass a route deviated toward the cooling member 33*a* from a tangent line (indicated by a broken line in FIG. 25) at a border point between the main heat absorbing surface 34*a* of the cooling member 33*a* having a curved surface shape and an auxiliary heat absorbing surface 36*a*. Between the cooling member 33*c* and the rollers 55*a* and 57*a*, the rotation trajectories of the belts 56 and 59 pass a route deviated toward the cooling member 33*c* from a tangent line (indicated by a broken line in FIG. 25) at a border point between the main heat absorbing surface 34*c* of the cooling member 33*c* having a curved surface shape and an auxiliary heat absorbing surface 36*c*.

Figure 26:
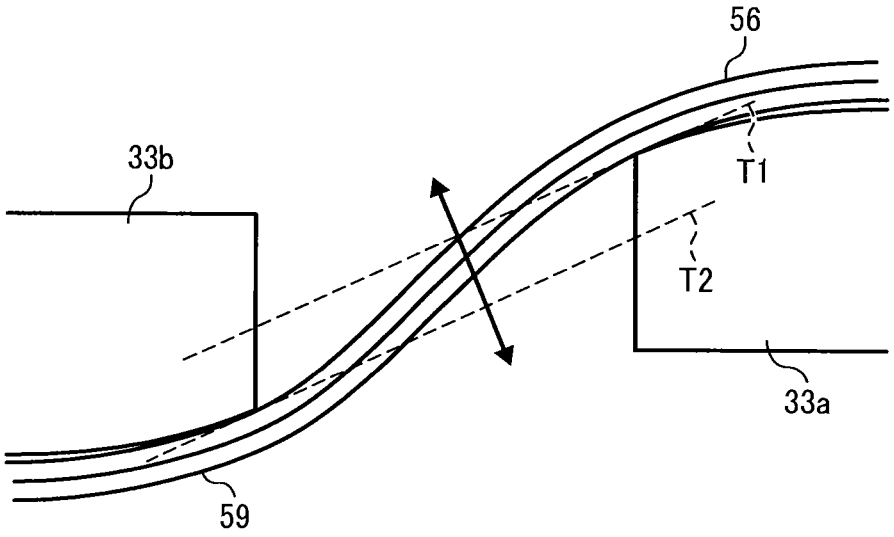
FIG. 26 is an enlarged view of belts between cooling members illustrated in FIG. 25.

FIG. 26 is an enlarged view of the belts 56 and 59 between the cooling members 33*a* and 33*b* illustrated in FIG. 25.

As illustrated in FIG. 26, before a recording material is conveyed, the rotation trajectories of the belts 56 and 59 between the adjacent cooling members 33*a* and 33*b* alternately disposed at an upper side and a lower side pass an area between two tangent lines T1 and T2 at border points between the main heat absorbing surfaces and the auxiliary heat absorbing surfaces of the two cooling members 33*a* and 33*b* deviated toward the cooling members. Between the adjacent cooling members 33*a* and 33*b*, each of the rotation trajectories of the belts 56 and 59 also passes a route deviated toward the corresponding one of the cooling members 33 from the corresponding tangent line. Specifically, the belt 59 contacting the cooling member 33*a* passes a route deviated toward the cooling member 33*a* (within a thickness of the cooling member 33*a*) from an upper tangent line T1 illustrated in FIG. 26. The belt 56 contacting the cooling member 33*b* passes a route deviated toward the cooling member 33*b* (within a thickness of the cooling member 33*b*) from a lower tangent line T2 illustrated in FIG. 26. The trajectories of the belts 56 and 59 between the cooling members 33*b* and 33*c* are similarly configured. Such a configuration allows heat of the recording material P to be absorbed with at least the entire main heat absorbing surfaces in the three cooling members 33*a*, 33*b*, and 33*c*. During conveyance of a recording material P, the belt 56 moves upward due to the thickness of the recording material and the rotation trajectory of the belt 56 passes a route deviated toward the cooling member 33*b* from the tangent line T2 at the border point of the cooling member 33*b*. Likewise, the belt 59 moves downward due to the thickness of the recording material and the rotation trajectory of the belt 59 passes a route deviated toward the cooling member 33*a* from the tangent line T1 at the border point of the cooling member 33*a*.

Figure 27A:
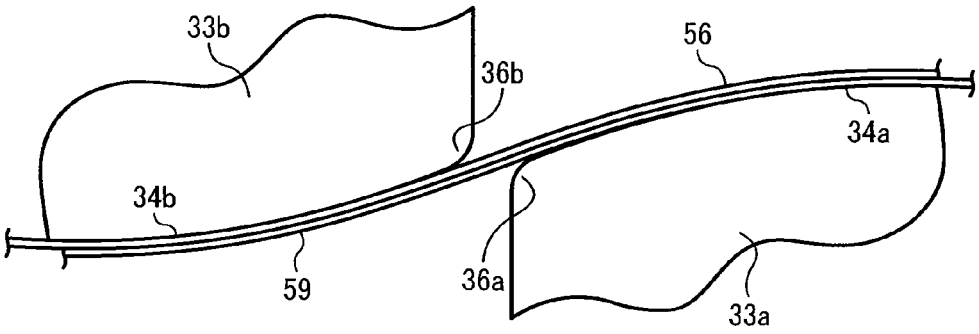
FIG. 27A through 27C are schematic front sectional views of a recording-material cooling device according to an embodiment of this disclosure.
Figure 27B:
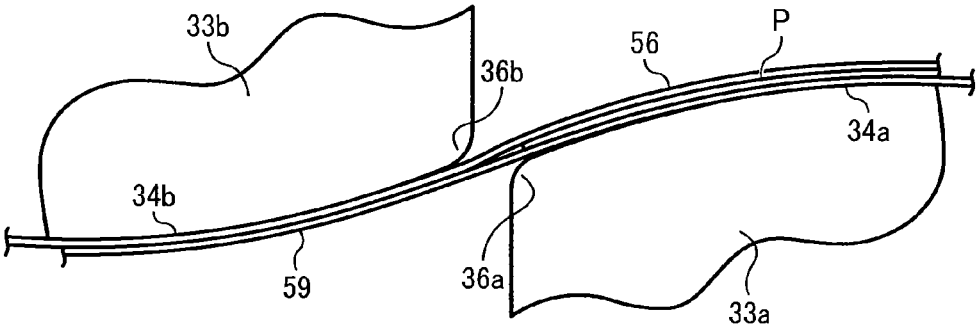
Figure 27C:
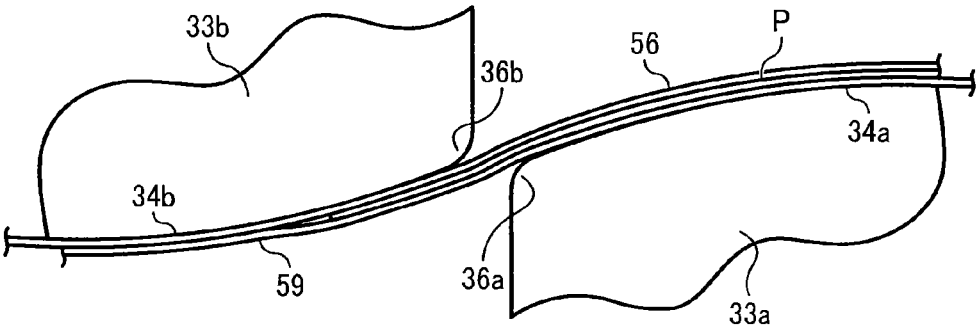

FIGS. 27A to 27C are schematic enlarged views of a recording-material cooling device according to an embodiment of this disclosure and are also enlarged views of a variation of belts 56 and 59 between cooling members 33*a* and 33*b*.

In this embodiment, as illustrated in FIG. 27A, the cooling members 33*a* and 33*b* are arranged so that a tangent line at a border point between a main heat absorbing surface 34*a* and an auxiliary heat absorbing surface 36*a* of the cooling member 33*a* is parallel to (has the same direction as) a tangent line at a border point between a main heat absorbing surface 34*b* and an auxiliary heat absorbing surface 36*b* of the cooling member 33*b*. As a result, the belts 56 and 59 contact each other from end to end of each cooling member. As illustrated in FIG. 27A, before a recording material P is conveyed, the rotation trajectories of the belts 56 and 59 between the adjacent cooling members 33*a* and 33*b* alternately disposed at an upper side and a lower side substantially coincide the two tangent lines at the border points between the main heat absorbing surfaces and the auxiliary heat absorbing surfaces of the two cooling members 33*a* and 33*b*. As illustrated in FIG. 27B, when a recording material P (in particular, a thick sheet of paper) is conveyed to a downstream side of the cooling member 33*a* in the recording-material transport direction, due to the thickness of the recording material P, the trajectory of the upper belt 56 passes a route deviated toward the cooling member 33*b* from the tangent line at the border point of the cooling member 33*b*. As illustrated in FIG. 27C, when the recording material P approaches an area between the adjacent cooling members 33*a* and 33*b*, due to the thickness of the recording material P, the rotation trajectory of the upper belt 56 passes a route deviated toward the cooling member 33*b* from the tangent line at the border point of the cooling member 33*b* and the rotation trajectory of the lower belt 59 passes a route deviated toward the cooling member 33*a* from the tangent line at the border point of the cooling member 33*a*.

Figure 28:
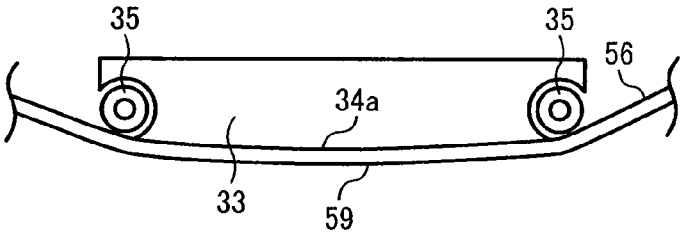
FIG. 28 is a schematic front sectional view of a recording-material cooling device according to an embodiment of this disclosure.

FIG. 28 is a schematic front sectional view of a recording-material cooling device according to an embodiment of this disclosure.

In this embodiment, at each end of a cooling member 33 in a recording-material transport direction, a cooling roller 35 is disposed adjacent to a main heat absorbing surface 34*a*. Each cooling roller 35 has a surface of a smaller radius than that of the main heat absorbing surface 34*a* and serves as an auxiliary heat absorbing surface. In this embodiment, the cooling member 33 may be either an air-cooling heat sink or a liquid cooling plate. The cooling rollers 35 may be either an air-cooling type or a liquid cooling type. For the air-cooling type, air flows through inside the cooling rollers 35. For the liquid-cooling type, coolant flows through inside the cooling rollers 35. Before a recording material is conveyed, each of the rotation trajectories of the belts 56 and 59 between the cooling member 33 and the roller 55*a* or 55*d* adjacent to the cooling member 33 passes a route deviated toward the cooling member 33 (upward) from a tangent line at a border point between the main heat absorbing surface 34*a* and each of the cooling rollers 35. At this time, the belt 56 contacts a portion of each cooling roller 35.

When a leading end of a recording material P (e.g., a thick sheet of paper) conveyed approaches the cooling roller 35 at an entry portion, the belt 56 is moved to an upper position than a position illustrated in FIG. 28 and the belt 59 is moved to a lower position than a position illustrated in FIG. 28. At this time, the belt 59 matches the tangent line or is placed at an upper position than the tangent line. The same is also applied to the tangent line at an exit portion.

Since the belt slides while contacting the cooling member at an acute angle, the belt might wear at a contact start point at which the belt starts contacting the cooling member. In the embodiment illustrated in FIG. 19, the auxiliary heat absorbing surface 36*a* having a smaller curvature radius than the main heat absorbing surface 34*a* is disposed to suppress wear of the belt. Instead, a rotatable cooling roller 35 having a small diameter may be disposed at each end of the cooling member 33. For example, each cooling roller 35 and the cooling member 33 are disposed in non-contact with each other in the first conveyance assembly 31.

In the above-described embodiments, the cooling member of the belt-type recording-material cooling device is not limited to an air-cooling heat sink or a liquid cooling plate but may be, for example, a cooling member employing a Peltier element, or a cooling plate in which a heat absorbing end of a heat pipe having a radiating end is embedded.

Figure 29:
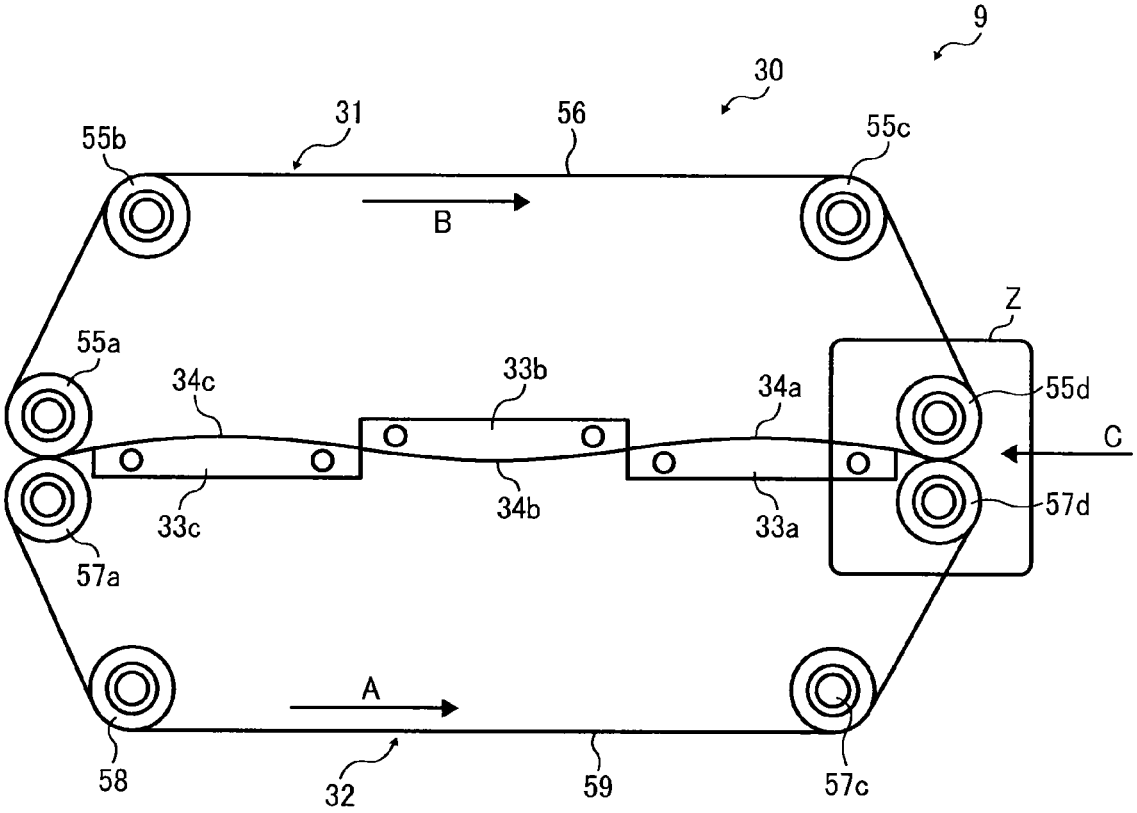
FIG. 29 is a schematic front sectional view of a recording-material cooling device according to an embodiment of this disclosure.

FIG. 29 is a schematic front sectional view of a recording-material cooling device according to an embodiment of this disclosure.

Cooling members 33*a*, 33*b*, and 33*c* are disposed offset in a transport direction of a recording material P indicated by arrow C. The cooling member 33*b* disposed at a front face side of the recording material P conveyed has, as a lower surface, a heat absorbing surface 34*b* of an arc surface shape slightly protruding downward. The cooling members 33*a* and 33*c* at the other face side have, as upper surfaces, heat absorbing surfaces 34*a* and 34*c* of an arc surface shape slightly protruding upward. Each of the cooling members 33*a*, 33*b*, and 33*c* includes a cooling-liquid channel through which cooling liquid flows. Similarly with FIG. 25, adjacent cooling members of the cooling members 33*a*, 33*b*, and 33*c* are arranged to overlap each other in a thickness direction (top-and-bottom direction in FIG. 25) of the cooling members 33*a*, 33*b*, and 33*c*.

Figure 30:
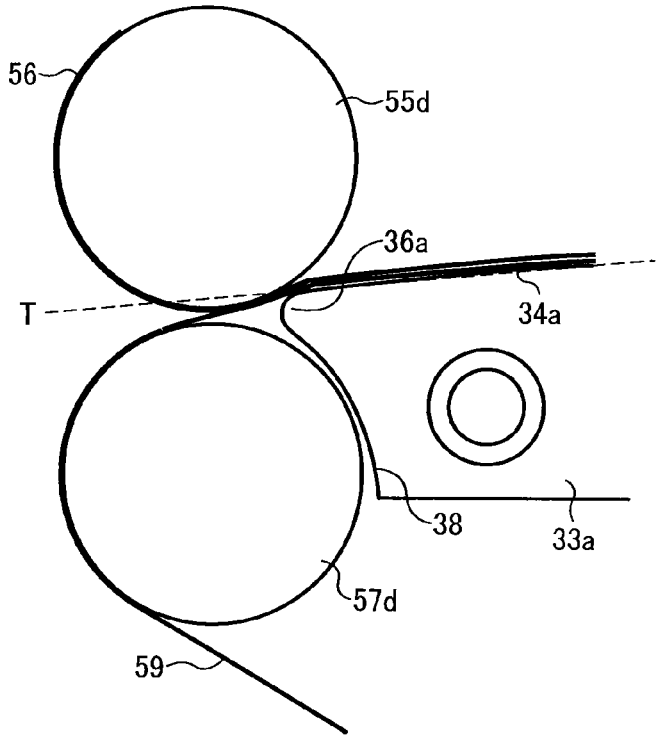
FIG. 30 is a schematic back sectional view of rollers and a cooling member illustrated in FIG. 28.

In this embodiment, the shape of the cooling members 33 and the size of the recording-material cooling device 9 are different from the above-described embodiment. FIG. 30 is a schematic back sectional view of rollers 55*d* and 57*d* and a portion of the cooling member 33*a* in an area Z illustrated in FIG. 29. As illustrated in FIG. 30, a lateral end of the cooling member 33*a* adjacent to the roller 57*d* in the recording-material transport direction C has a recessed portion 38 corresponding to a surface of the roller 57*d*. In this embodiment, at an entry portion of the cooling member 33*a* in the recording-material transport direction C, an auxiliary heat absorbing surface 36*a* having a curved surface of a smaller curvature radius than that of the main heat absorbing surface 34*a* is disposed adjacent to the main heat absorbing surface 34*a*. The recessed portion 38 is recessed inward from the auxiliary heat absorbing surface 36*a* of the cooling member 33, and the roller 57*d* is disposed at the recessed portion 38 in non-contact with the cooling member 33*a*. Accordingly, as illustrated in FIG. 30, the roller 55*d* and the roller 57*d* partially crawl under the cooling member 33*a* in the vicinity of the cooling member 33*a*, thus allowing a compact structure of the recording-material cooling device 9. For a configuration in which the recessed portion 38 has a shape formed along the curved surface of the roller 57*d*, the roller 57*d* can further crawl under the cooling member 33*a*, thus allowing a more compact structure of the recording-material cooling device 9. The recessed portion 38 may be formed at the opposite lateral end of the cooling member in the recording-material transport direction. For such a configuration, the rollers 55*a* and 57*a* are also disposed in the vicinity of the cooling member 33*c*, thus allowing the roller 57*a* to partially crawl under the cooling member 33*c*.

In the arrangement of the first conveyance assembly 31 and the second conveyance assembly 32 illustrated in FIG. 25, belt surface areas not contacting the cooling members 33*a* and 33*c* are relatively large. The amount of heat which such non-contact surface areas absorb from a recording material is smaller than the amount of heat which belt surface areas contacting the cooling members absorb from the recording material. Accordingly, as in this embodiment, by reducing the non-contact surface areas, the recording material can be efficiently cooled, and the first conveyance assembly 31 and the second conveyance assembly 32 can be downsized with respect to the recording-material transport direction. In addition, the recording-material cooling device can be configured at a relatively low cost using a single type of cooling member having recessed portions at both lateral end portions.

In FIG. 30, a line T is a tangent line at a border point between the main heat absorbing surface 34*a* and the auxiliary heat absorbing surface 36*a* of the cooling member 33*a*. The rotation trajectory of the belt 59 passes a route deviated toward the cooling member 33*a* from the tangent line T. A lower surface of the roller 55*d* protrudes downward beyond the tangent line. Accordingly, the rotation trajectory of the belt 56 passes a route deviated toward the cooling member 33 from the tangent line T. The roller 55*d* is disposed away from the roller 57*d* and does not conflict the cooling member 33*a*. At this time, a contact point between the belt 56 and the belt 59 is disposed upstream from the lateral end of the cooling member 33*a* in the recording-material transport direction and near a lower portion of the roller 55*d*. Accordingly, a contact area between the belt 56 and the belt 59 ranges from the upstream contact point to a contact point downstream in the recording-material transport direction through an area above the cooling member 33*a*

Figure 31:
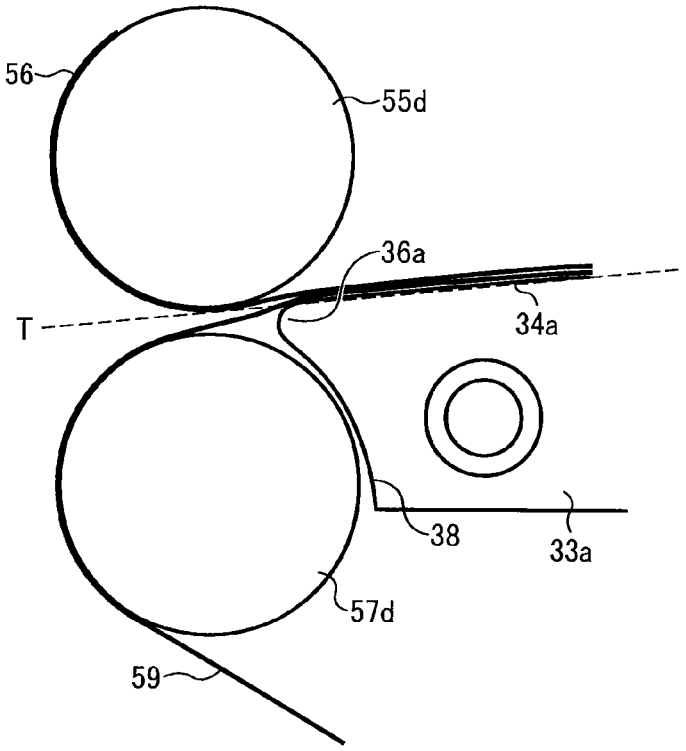
FIG. 31 is a schematic back sectional view of rollers and a cooling member according to an embodiment of this disclosure.

FIG. 31 is a schematic back sectional view of a recording-material cooling device 9 according to an embodiment of this disclosure, and also a schematic back sectional view of rollers 55*d* and 57*d* and a cooling member 33*a*.

In this embodiment, the roller 55*d* is positioned at a position upper than the roller 55*d* illustrated in FIG. 30, and thus the rotation trajectory of a belt 56 passes substantially on a tangent line T. The rotation trajectory of a belt 59 passes a route deviated toward the cooling member 33 from the tangent line T. At this time, a contact point between the belt 56 and the belt 59 is disposed on a heat absorbing surface of the cooling member 33*a*.

Figure 32:
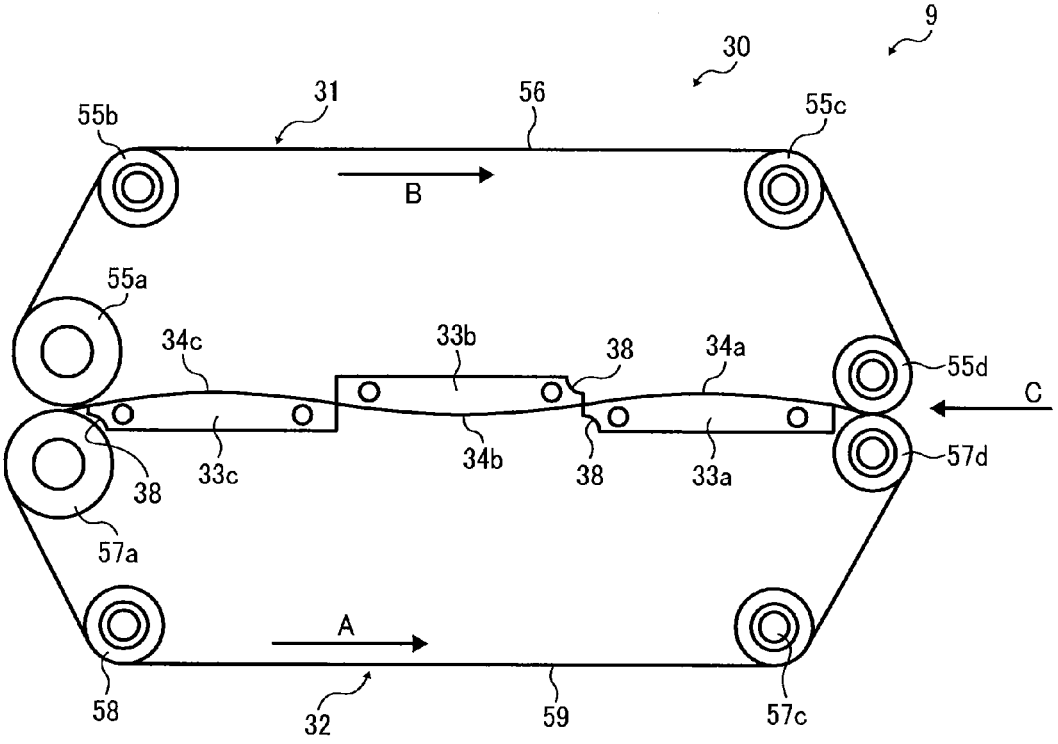
FIG. 32 is a schematic front sectional view of a recording-material cooling device according to an embodiment of this disclosure.

FIG. 32 is a schematic front sectional view of a recording-material cooling device 9 according to an embodiment of this disclosure.

In this embodiment, the recording-material cooling device 9 is different from the recording-material cooling device 9 illustrated in FIG. 29 or 30 in that a recessed portion 38 is disposed at only one end of each of cooling members 33*a*, 33*b*, and 33*c* in a recording-material transport direction indicated by arrow C in FIG. 32. A driving roller 57*a* illustrated in FIG. 32 is different from the driving roller 57*a* illustrated in FIG. 29 or 30.

The driving roller 57*a* has a greater diameter than a driven roller 57*d*. In such a case, it is conceivable that a recessed portion 38 disposed at a side face of the cooling member 33*c* facing the driving roller 57*a* has a different shape from a recessed portion disposed at a side face of the cooling member 33*a* facing the driven roller 57*d*. However, such a configuration increases processing cost of the cooling members 33.

Hence, in this embodiment, the recessed portion 38 is disposed only at the side face of the cooling member 33*c* facing the roller (driving roller 57*a*) having a greater diameter. By contrast, no recessed portion is disposed at the side face of the cooling member 33*a* that faces the driven roller 57*d* having a smaller diameter than the driving roller 57*a*. This is because the smaller diameter of the driven roller 57*d* allows the cooling member 33*a* to be disposed near the driven roller 57*d* even if the side face of the cooling member 33*a* facing the driven roller 57*d* has no recessed portion. Accordingly, the driving roller 57*a* is disposed in the vicinity of the cooling member 33*c* so as to partially crawl under the cooling member 33*c*, thus allowing a more compact structure of the recording-material cooling device 9. For a configuration in which the recessed portion 38 has a shape formed along the curved surface of the driving roller 57*a*, the driving roller 57*a* can further crawl under the cooling member 33*c*, thus allowing a more compact structure of the recording-material cooling device 9.

In addition, as illustrated in FIG. 32, all of the cooling members 33*a*, 33*b*, and 33*c* in a belt conveyance unit 30 have the recessed portions 38 at the same position. In other words, when the main heat absorbing surface 34 of each cooling member 33 is faced up (like the cooling member 33*c* in FIG. 32), each cooling member 33 has the recessed portion 38 at the left side. The cooling member 33*c* and the cooling member 33*a* are disposed in the same orientation. The cooling member 33*b* is disposed at a position at which the cooling member 33*b* is rotated 180 degrees relative to the cooling member 33*c*. Accordingly, all of the cooling members 33 used in the belt conveyance unit 30 have the same shape and are subjected to the same processing, thus allowing cost reduction.

At this time, the shapes and relative positions of the cooling member 33*c*, the cooling member 33*b*, the belt 56, and the belt 59 are the same as those of FIG. 26 or 27.

Figure 33A:
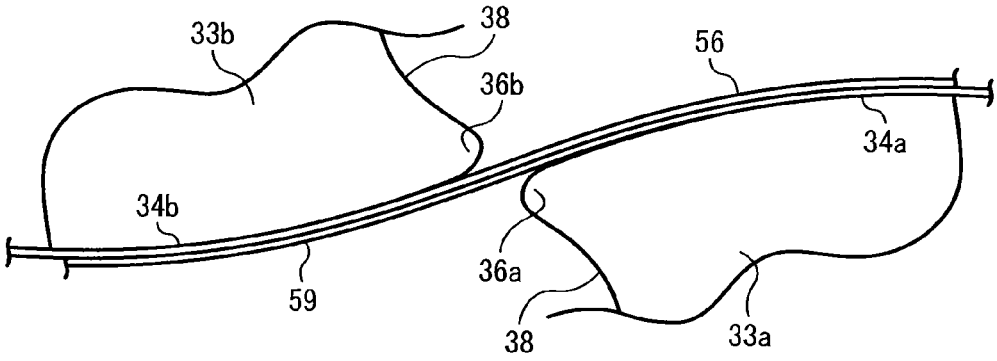
FIGS. 33A through 33C are schematic views of an example of shapes and relative positions of cooling members and belts.
Figure 33B:
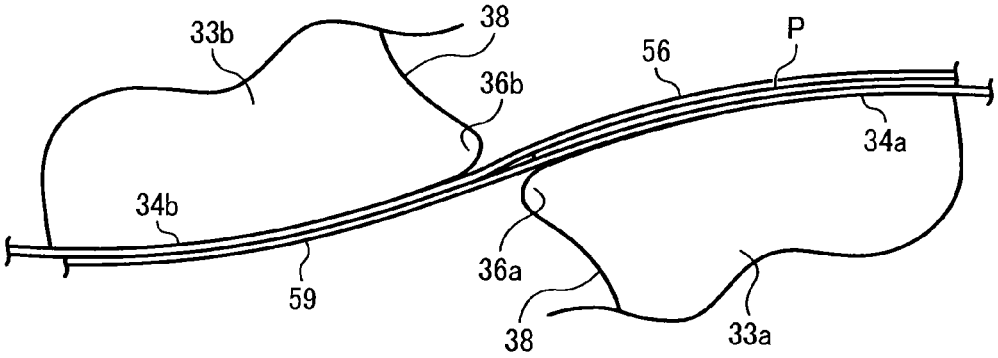
Figure 33C:
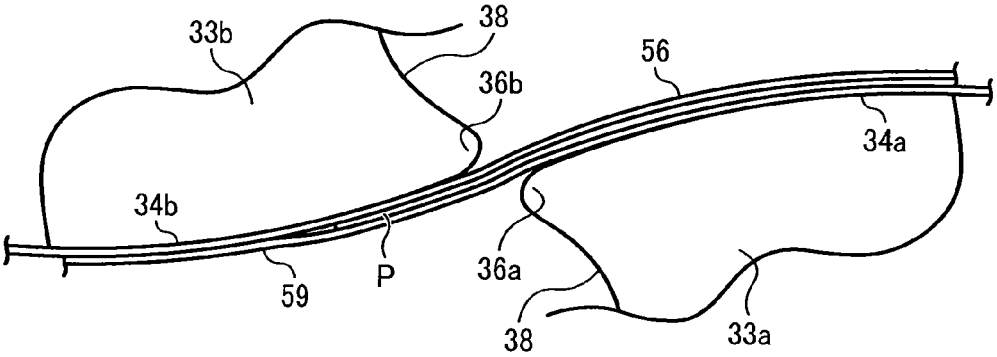

The shapes and relative positions of the cooling member 33*a*, the cooling member 33*b*, the belt 56, and the belt 59 are illustrated in FIGS. 33A through 33C.

The cooling member 33*a* and the cooling member 33*b* are arranged so that a tangent line at a border point between a main heat absorbing surface 34*a* and an auxiliary heat absorbing surface 36*a* of the cooling member 33*a* is parallel to (has the same direction as) a tangent line at a border point between a main heat absorbing surface 34*b* and an auxiliary heat absorbing surface 36*b* of the cooling member 33*b* (see FIG. 33A). As a result, the belts 56 and 59 contact each other from end to end of each cooling member. As illustrated in FIG. 33A, before a recording material P is conveyed, the rotation trajectories of the belts 56 and 59 between the adjacent cooling members 33*a* and 33*b* alternately disposed at an upper side and a lower side substantially coincide two tangent lines at the border points between the main heat absorbing surfaces and the auxiliary heat absorbing surfaces of the two cooling members 33*a* and 33*b*. As illustrated in FIG. 33B, when a recording material P (in particular, a thick sheet of paper) is conveyed to a downstream side of the cooling member 33*a* in the recording-material transport direction, due to the thickness of the recording material P, the trajectory of the upper belt 56 passes a route deviated toward the cooling member 33*b* from the tangent line at the border point of the cooling member 33*b*. As illustrated in FIG. 33C, when the recording material P approaches an area between the adjacent cooling members 33*a* and 33*b*, due to the thickness of the recording material P, the rotation trajectory of the upper belt 56 passes a route deviated toward the cooling member 33*b* from the tangent line at the border point of the cooling member 33*b* and the rotation trajectory of the lower belt 59 passes a route deviated toward the cooling member 33*a* from the tangent line at the border point of the cooling member 33*a*.

Instead of the configuration illustrated in FIGS. 33A to 33C, as illustrated in FIG. 26, the rotation trajectories of the belts 56 and 59 between the adjacent cooling members 33*a* and 33*b* alternately disposed at an upper side and a lower side may be arranged so as to pass an area between two tangent lines at border points between the main heat absorbing surfaces and the auxiliary heat absorbing surfaces of the two cooling members 33*a* and 33*b* deviated toward the cooling member. Between the adjacent cooling members 33*a* and 33*b*, the rotation trajectories of the belts 56 and 59 also pass a route deviated toward the corresponding one of the cooling members 33 from the corresponding tangent line.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A recording-material cooling device disposed downstream from a fixing device in a transport direction of a recording material, the fixing device including a fixing member and a pressing member to fix an unfixed toner image on the recording material, the fixing member including a heater, the pressing member contacting the fixing member to form a fixing nip, the recording-material cooling device comprising:

a first cooler including a corresponding fluid flow path to cool the first cooler, the first cooler disposed at a same side as the pressing member relative to the recording material;

a second cooler including a corresponding fluid flow path to cool the second cooler, the second cooler disposed at a same side as the fixing member relative to the recording material; and a third cooler including a corresponding fluid flow path to cool the third cooler, the third cooler disposed at the same side as the pressing member relative to the recording material, the first cooler, the second cooler, and the third cooler arranged in an order of the first cooler, the second cooler, and the third cooler from upstream to downstream in the transport direction of the recording material, the first cooler, the second cooler, and the third cooler disposed to contact a belt that conveys the recording material.

2. The recording-material cooling device according to claim 1, wherein the recording-material cooling device is a liquid cooling type cooling device to circulate a cooling liquid in an order of the third cooler, the second cooler, and the first cooler.

3. The recording-material cooling device according to claim 1, wherein the third cooler cools the recording material to a temperature not higher than a toner adherence avoidance temperature which is lower than a toner solidification temperature, the toner adherence avoidance temperature being a temperature at which the recording material does not adhere to another recording material via toner by a blocking phenomenon.

4. The recording-material cooling device according to claim 1, wherein a portion of the pressing member corresponding to an interval between the recording material and a subsequent recording material causes a high temperature portion higher in temperature than another portion of a back face of the recording material, and wherein the first cooler cools the high temperature portion of the back face of the recording material to a temperature not higher than a toner solidification temperature.

5. The recording-material cooling device according to claim 4, wherein the recording-material cooling device is a liquid cooling type cooling device to circulate a cooling liquid in an order of the third cooler, the second cooler, and the first cooler.

6. The recording-material cooling device according to claim 1, further comprising:

a second belt rotatably wound around plural rollers and disposed opposing said belt to contact and convey the recording material, wherein each of the first cooler, the second cooler, and the third cooler contacts an inner circumferential surface of one of the belts.

7. The recording-material cooling device according to claim 6, further comprising:

a fourth cooler to cool a higher temperature one of a front face and a back face of the recording material cooled by the second cooler, wherein the fourth cooler is disposed between the second cooler and the third cooler.

8. An image forming apparatus, comprising:

the recording-material cooling device according to claim 1; and the fixing device including the fixing member and the pressing member to fix an unfixed toner image on the recording material, the fixing member including the heater, the pressing member contacting the fixing member to form the fixing nip.

9. A recording-material cooling device, comprising:

a first conveyance assembly including a plurality of first stretching members and a first belt rotatably stretched by the plurality of first stretching members;

a second conveyance assembly including a plurality of second stretching members and a second belt rotatably stretched by the plurality of second stretching members, the first conveyance assembly and the second conveyance assembly arranged to contact and convey a recording material with the first belt and the second belt while cooling the recording material; and a cooler contacting an inner circumferential surface of at least one of the first belt and the second belt, wherein the cooler has a main heat absorbing surface and an auxiliary heat absorbing surface, the auxiliary heat absorbing surface having a curved surface of a smaller curvature radius than a curvature radius of a curved surface of the main heat absorbing surface, and wherein at least one of a rotation trajectory of the first belt and a rotation trajectory of the second belt passes a route deviated toward the cooler from a tangent line at a border point between the main heat absorbing surface and the auxiliary heat absorbing surface, wherein, in an area between the cooler and one of the plurality of first stretching members and the plurality of second stretching members adjacent to the cooler, the at least one of the rotation trajectory of the first belt and the rotation trajectory of the second belt passes a route deviated toward the cooler from the tangent line at the border point between the main heat absorbing surface and the auxiliary heat absorbing surface.

10. The recording-material cooling device according to claim 9, wherein the inner circumferential surface of the at least one of the first belt and the second belt contacts the auxiliary heat absorbing surface of the cooler.

11. The recording-material cooling device according to claim 9, wherein the rotation trajectory of the first belt and the rotation trajectory of the second belt are not parallel to each other between the cooler and one of the plurality of first stretching members and the plurality of second stretching members at an entry side of the recording-material cooling device at which the recording material enters the recording-material cooling device.

12. The recording-material cooling device according to claim 9, further comprising a cooling roller serving as the auxiliary heat absorbing surface at each end of the cooler in a transport direction of the recording material.

13. The recording-material cooling device according to claim 9, wherein each of the first conveyance assembly and the second conveyance assembly includes the cooler, and wherein, in an area between adjacent coolers of the cooler of the first conveyance assembly and the cooler of the second conveyance assembly, the rotation trajectory of the first belt and the rotation trajectory of the second belt pass between a first tangent line at a first border point between a main heat absorbing surface and an auxiliary heat absorbing surface of an upstream one of the adjacent coolers and a second tangent line at a second border point between a main heat absorbing surface and an auxiliary heat absorbing surface of a downstream one of the adjacent coolers in a transport direction of the recording material, and each of the rotation trajectory of the first belt and the rotation trajectory of the second belt passes a route deviated from the first tangent line toward the main heat absorbing surface of the downstream one of the adjacent coolers.

14. The recording-material cooling device according to claim 13, wherein, when the recording material approaches the area between the adjacent coolers, at least one of the rotation trajectory of the first belt and the rotation trajectory of the second belt passes a route deviated from the first tangent line toward the main heat absorbing surface of the downstream one of the adjacent coolers.

15. The recording-material cooling device according to claim 9, wherein the cooler has a lateral end adjacent to one of the plurality of first stretching members and the plurality of second stretching members in a transport direction of the recording material, the lateral end has a recessed portion corresponding to a surface of the one of the plurality of first stretching members and the plurality of second stretching members, and the one of the plurality of first stretching members and the plurality of second stretching members is disposed at the recessed portion without contacting the cooler.

16. An image forming apparatus, comprising the recording-material cooling device according to claim 9.

17. A recording-material cooling device disposed downstream from a fixing device in a transport direction of a recording material, the fixing device including a fixing member and a pressing member to fix an unfixed toner image on the recording material, the fixing member including a heater, the pressing member contacting the fixing member to form a fixing nip, the recording-material cooling device comprising:

a pressing-member-side cooler including a fluid flow path to cool the pressing-member-side cooler, the pressing-member-side cooler disposed at a same side as the pressing member relative to the recording material; and a fixing-member-side cooler including a fluid flow path to cool the fixing-member-side cooler, the fixing-member-side cooler disposed at a same side as the fixing member relative to the recording material, the pressing-member-side cooler and the fixing-member-side cooler arranged in an order of the pressing-member-side cooler and the fixing-member-side cooler from upstream to downstream in the transport direction of the recording material, a size of the pressing-member-side cooler being larger than a size of the fixing-member-side cooler, an amount of heat which the pressing-member-side cooler absorbs from the recording material is greater than an amount of heat which the fixing-member-side cooler absorbs from the recording material.

18. An image forming apparatus, comprising the recording-material cooling device according to claim 17.

19. A recording-material cooling device disposed downstream from a fixing device in a transport direction of a recording material, the fixing device including a fixing member and a pressing member to fix an unfixed toner image on the recording material, the fixing member including a heater, the pressing member contacting the fixing member to form a fixing nip, the recording-material cooling device comprising:

a first cooler to cool the recording material, the first cooler including a fluid flow path to cool the first cooler, disposed at a same side as the pressing member relative to the recording material, the first cooler including a heat absorbing surface which absorbs heat through contact;

a second cooler to cool the recording material, the second cooler including a fluid flow path to cool the second cooler, disposed at a same side as the fixing member relative to the recording material, the second cooler including a heat absorbing surface which absorbs heat through contact, the first cooler being longer than the second cooler in the transport direction of the recording material.

20. An image forming apparatus, comprising the recording-material cooling device according to claim 19.

21. The recording-material cooling device according to claim 19, wherein:

the heat absorbing surface of the first cooler cools the recording material by contact with a first belt which is between the first cooler and the recording material, and the heat absorbing surface of the second cooler cools the recording material by contact with a second belt which is between the second cooler and the recording material.

* * * * *